US011189227B1

(12) United States Patent
Zhang et al.

(10) Patent No.: US 11,189,227 B1
(45) Date of Patent: Nov. 30, 2021

(54) DISPLAY PANEL, DRIVING METHOD THEREOF, AND DISPLAY DEVICE

(71) Applicant: Shanghai Tianma AM-OLED Co., Ltd., Shanghai (CN)

(72) Inventors: Mengmeng Zhang, Shanghai (CN); Yana Gao, Shanghai (CN); Xingyao Zhou, Shanghai (CN); Ranran Zeng, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 17/006,616

(22) Filed: Aug. 28, 2020

(30) Foreign Application Priority Data

May 29, 2020 (CN) ..... 202010479903.8

(51) Int. Cl.
*G09G 3/325* (2016.01)
*G09G 3/3275* (2016.01)
*G09G 3/3266* (2016.01)

(52) U.S. Cl.
CPC ..... *G09G 3/325* (2013.01); *G09G 3/3266* (2013.01); *G09G 3/3275* (2013.01)

(58) Field of Classification Search
CPC ..... G09G 3/325; G09G 3/3275; G09G 3/3266
See application file for complete search history.

(56) References Cited

U.S. PATENT DOCUMENTS

2006/0055336 A1* 3/2006 Jeong ..... G09G 3/3233 315/169.3
2016/0035805 A1* 2/2016 Kim ..... G09G 3/3225 345/76
2017/0270853 A1* 9/2017 Xiang ..... G09G 3/3275
2018/0342570 A1* 11/2018 Hong ..... H01L 27/326
2021/0049959 A1* 2/2021 Park ..... G09G 3/325
2021/0057502 A1* 2/2021 Kim ..... H01L 27/124

FOREIGN PATENT DOCUMENTS

CN 106710529 A 5/2017
CN 110675816 A 1/2020

* cited by examiner

*Primary Examiner* — Premal R Patel
(74) *Attorney, Agent, or Firm* — Alston & Bird LLP

(57) ABSTRACT

The display panel includes an array substrate, and the array substrate includes pixel circuits arranged in an array. A first initialization module and a second initialization module are connected in series to an initialization signal terminal and a control terminal of the drive module, an output terminal of the second initialization module is electrically connected to the control terminal of the drive module; a control terminal of the first initialization module is used for receiving a first additional scan signal, and a control terminal of the second initialization module is used for receiving a first scan signal. Within at least one light emitting period of one frame duration, the end time of an active level pulse of the first additional scan signal is later than the end time of an active level pulse of the first scan signal.

20 Claims, 16 Drawing Sheets

DISPLAY PANEL, DRIVING METHOD THEREOF, AND DISPLAY DEVICE

CROSS-REFERENCE TO RELATED APPLICATIONS

This application claims priority to Chinese patent application No. CN202010479903.8 filed with CNIPA on May 29, 2020, the disclosure of which is incorporated herein by reference in its entirety.

TECHNICAL FIELD

The present disclosure relates to a field of display technology and, particularly, to an array substrate, a driving method of the array substrate, a display panel and a display device.

BACKGROUND

Active Matrix Organic Light Emitting Diode (AMOLED) display panels have gradually entered the market of display technologies. Compared with conventional Thin Film Transistor Liquid Crystal Display (TFT LCD) panels, the AMOLED Display panels have advantages of low energy consumption, self-luminescence, wide view angle, high response speed, easy applicability to a flexible display technology, etc. The AMOLED display panel may generally be driven by a current, that is, the drive current is used to control a light emitting module to emit light.

In order to control the drive current flowing through the light emitting module, a pixel circuit is usually required. At present, when the pixel circuit drives the light emitting module to emit light, a display panel in an idle mode has a significant flicker phenomenon and poor image display effect.

SUMMARY

The present disclosure provides an array substrate, a driving method of the array substrate, a display panel and a display device.

In a first aspect, the embodiments of the present disclosure provide an array substrate. The array substrate include a plurality of pixel circuits arranged in an array, where the pixel circuit includes a drive module, a first initialization module, a second initialization module, a first light emitting control module, a data writing module and a light emitting module.

the drive module is used for generating a drive current;

the first initialization module and the second initialization module are connected in series between an initialization signal terminal and a control terminal of the drive module, an output terminal of the second initialization module is electrically connected to the control terminal of the drive module, and an output terminal of the first initialization module and an input terminal of the second initialization module each are electrically connected to a first intermediate node;

the first light emitting control module is used for transmitting a first power signal to an input terminal of the drive module; the data writing module is used for transmitting a data signal to the input terminal of the drive module;

the light emitting module is connected in series between the drive module and a second power signal terminal, a first electrode of the light emitting module is electrically connected to a reset node, and a second electrode of the light emitting module is electrically connected to the second power signal terminal;

a control terminal of the first initialization module is used for receiving a first additional scan signal, a control terminal of the second initialization module is used for receiving a first scan signal, a control terminal of the first light emitting control module is used for receiving a light emitting control signal, and a control terminal of the data writing module is used for receiving a second scan signal; and within at least one light emitting period of one frame duration, end time of an active level pulse of the first additional scan signal is later than end time of an active level pulse of the first scan signal.

In a second aspect, the embodiments of the present disclosure further provide a display panel. The display panel includes any one array substrate provided in the first aspect.

In a third aspect, the embodiments of the present invention further provide a display device. The display device includes any one display panel provided in the second aspect.

In a fourth aspect, the embodiments of the present disclosure further provide a driving method of an array substrate, where the driving method is used to drive any one array substrate provided in the first aspect, and the driving method at least includes:

providing a first additional scan signal to the control terminal of the first initialization module; or providing a first scan signal to the control terminal of the second initialization module;

within at least one light emitting period of one frame duration, end time of an active level pulse of the first additional scan signal is later than end time of an active level pulse of the first scan signal.

DETAILED DESCRIPTION

Figure 1:
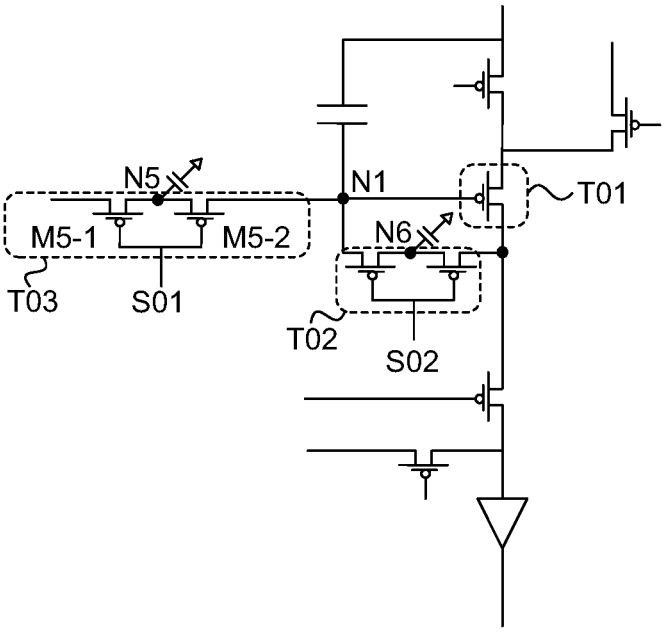
FIG. 1 is a structural diagram of a pixel circuit in an array substrate in the related art.

Hereinafter the present disclosure will be further described in detail with reference to the drawings and embodiments It is to be understood that the specific embodiments set forth below are intended to illustrate and not to limit the present disclosure. Additionally, it is to be noted that, for ease of description, only part, not all, of the structures related to the present disclosure are illustrated in the drawings.

Figure 2:
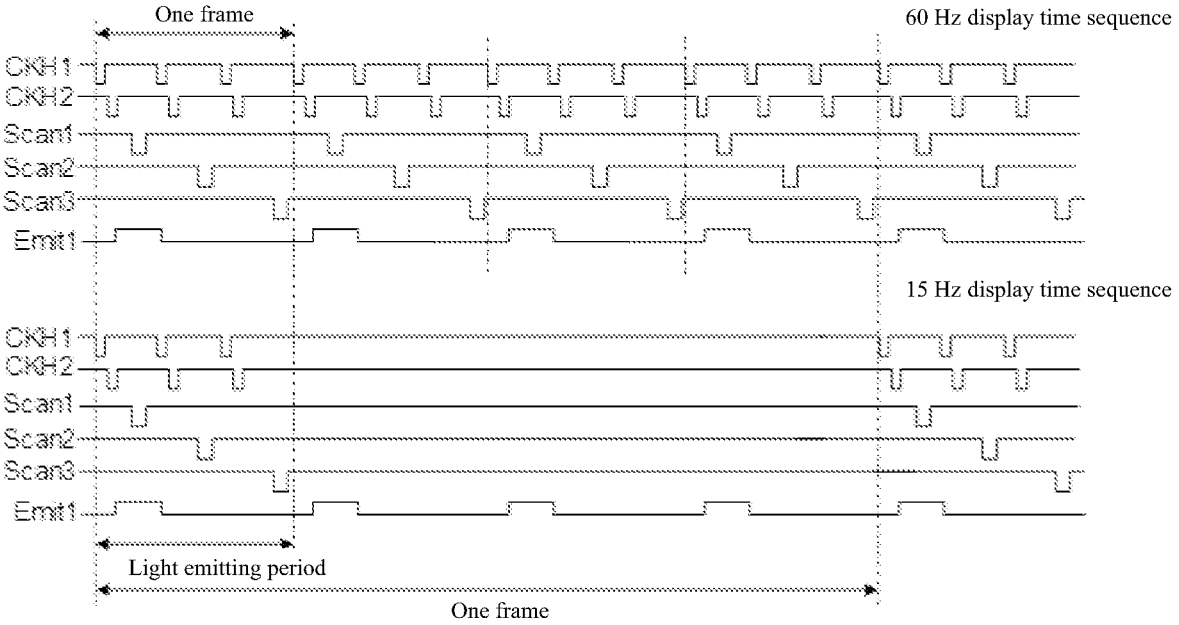
FIG. 2 is a drive time sequence of the pixel circuit shown in FIG. 1.
Figure 3:
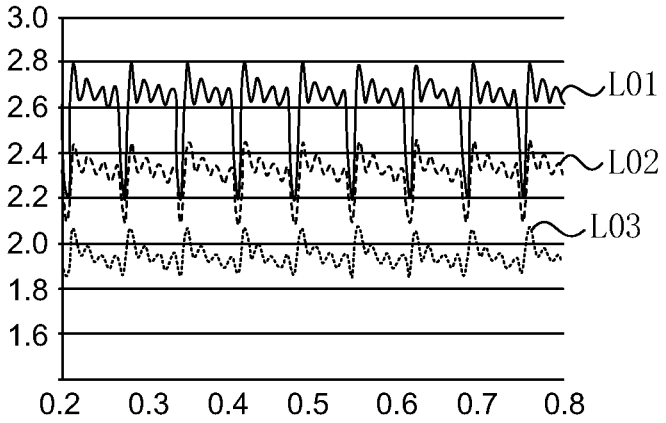
FIG. 3 illustrates plots of brightness signals variation of the pixel circuit shown in FIG. 1 at a 15 Hz display time sequence shown in FIG. 2.

FIG. 1 is a structural diagram of a pixel circuit in an array substrate in the related art, FIG. 2 is a schematic diagram of a drive time sequence of the pixel circuit shown in FIG. 1, and FIG. 3 is a schematic diagram illustrating variation of brightness of the pixel circuit shown in FIG. 1 at a 15 Hz display time sequence shown in FIG. 2. With reference to FIG. 1 to FIG. 3, in the related art, the pixel circuit shown in FIG. 1 executes the timing sequence shown in FIG. 2 to implement image display in a normal mode and an idle mode, respectively. Exemplarily, FIG. 2 shows drive time sequences of the pixel circuit corresponding to the normal mode and the idle mode at a 60 Hz display time sequence and a 15 Hz display time sequence, respectively.

Exemplarily, when a display panel (of a wearable product, for example) including the array substrate displays an image in the idle mode, low frequency display is generally used (such as, the 15 HZ drive time sequence is used for display). In the low frequency display, the pixel circuit maintains the potential through a storage capacitor. A control chip connected to the pixel circuit does not output after output one frame of data. At this time, clock signals CKH1 and CKH2 input to the scan drive circuit are pulled high, and correspondingly, scan signals Scan1, Scan2, and Scan3 output by the scan drive circuit are pulled high, as shown in FIG. 2. With continued reference to FIG. 2, comparison between the 60 Hz display time sequence and 15 Hz display time sequence shows that in the 60 Hz display time sequence, the data refresh is performed in each frame; while in the 15 Hz display time sequence, the data refresh is completed only in a first light emitting period of the current frame, and in last three light emitting periods of the current frame, the clock signals CKH1 and CKH2 are leveled, and the scan signals Scan1, Scan2, and Scan3 are leveled, that is, data of the first light emitting period is kept, the data is not refreshed, and only the light emitting signal Emit1 is used to control whether to emit light or not.

With reference to FIG. 1, the pixel circuit may include a drive transistor T01, a first double-gate transistor T03, and a second double-gate transistor T02; a control terminal of the drive transistor T01, an output terminal of the first double-gate transistor T03, and an output terminal of the second double-gate transistor T02 each are electrically connected to a first node N1, a control terminal of the first double-gate transistor T03 is electrically connected to a first gate control terminal S01, and a control terminal of the second double-gate transistor T02 is electrically connected to a second gate control terminal S02. Since the first double-gate transistor T03 and the second double-gate transistor T02 have certain parasitic capacitances, when level signals of the first gate control terminal S01 and the second gate control terminal S02 vary, exemplarily, when the level signals vary from an active level signal to an inactive level signal, potentials of intermediate nodes (shown as N5 and N6 in FIG. 1 respectively) of the first double-gate transistor T03 and the second double-gate transistor T02 will vary accordingly in a coupling manner. During a subsequent period of maintaining the potential of the first node N1, electric leakage occurs from the intermediate node to the first node, or from the first node to the intermediate node, causing the potential of the first node N1 to vary, for example, the potential is pulled up or pulled down, thereby affecting a drive current generated by the drive transistor T01, and a phenomenon of brightness decrease or brightness increase occurs, that is, brightness jitter occurs.

With reference to FIG. 3, the phenomenon of brightness jitter caused by the brightness decrease will be described exemplarily. In FIG. 3, the abscissa represents time, the ordinate represents brightness, and brightness curves L01, L02, and L03 are brightness variation curves with time under different brightness, respectively; specifically, L01 represents a brightness variation curve under low brightness, and L02 represents a brightness variation curve of a middle grayscale, and L03 represents a variation curve of high brightness. The lower a downward low valley is relative to other low valleys, the lower the grayscale is.

Exemplarily, In conjunction with FIG. 2 and FIG. 3, when the level signals of the first gate control terminal S01 and the second gate control terminal S02 leap from low levels to high levels, the potentials of the intermediate nodes N5 and N6 of the first double-gate transistor T03 and the second double-gate transistor T02 are pulled high due to coupling, and in a subsequent stage of maintaining potential of the first node N1, high potentials of the two intermediate nodes N5 and N6 leak to the first node N1, so that the potential of the first node N1 is pulled up, and the phenomenon of brightness decrease occurs, that is the jitter occurs.

Specifically, when an Organic Light Emitting Diode (OLED) emits light, the light emitting signal Emit1 needs to be turned on, as the brightness curve shown in FIG. 3, in a time period corresponding to 1 frame of 15 Hz, the light emitting signal Emit1 is turned off 4 times (in FIG. 2, a high level shows an inactive level), so that the brightness drops 4 times. When the light emitting signal Emit1 is turned off for the first time, because an anode of the OLED uses a low potential to reset, the OLED will stop emitting light rapidly and emit undesired light; next, when the light emitting signal Emit1 is turned on, firstly, a capacitor of the OLED needs to be charged, and then, the light emitting is carried out, that is, the light emitting time has a certain lag; the light emitting signal Emit1 is turned off for the following three times, the OLED is not completely turned off without a process of resetting the OLED, and the OLED emit undesired light; meanwhile, because the anode is not reset, the capacitor of the OLED does not need to be charged when the light emitting signal Emit1 is turned on. The OLED can emit light rapidly, so that the bright does not drop obviously. The difference between the first time and the following three times makes human eyes to recognize the significant brightness drop in the first time. Therefore, when the display is performed by using the 15 Hz display time sequence, because the brightness of each frame is different, an obvious flicker phenomenon will occur, that is, a brightness fluctuation with a cycle of 15 Hz will occur during the 15 Hz display, and the flicker phenomenon will be observed by human eyes.

In view of the above, embodiments of the present disclosure provide an array substrate, a driving method of the array substrate, a display panel, and a display device. For at least one of the above-mentioned reasons, a drive time sequence is set to reduce a coupling potential of the intermediate node N5 and/or N6, or to increase a reset frequency of the anode of the OLED, so that a brightness variation of the OLED is not distinguishable to the human eyes, thereby alleviating the flicker phenomenon.

The above is the core idea of the present disclosure, embodiments of the present disclosure will be described clearly and completely in conjunction with FIG. 4 to FIG. 29 in embodiments of the present disclosure. Based on embodiments of the present disclosure, all other embodiments obtained by those skilled in the art without making creative work are within the scope of the present disclosure.

Figure 4:
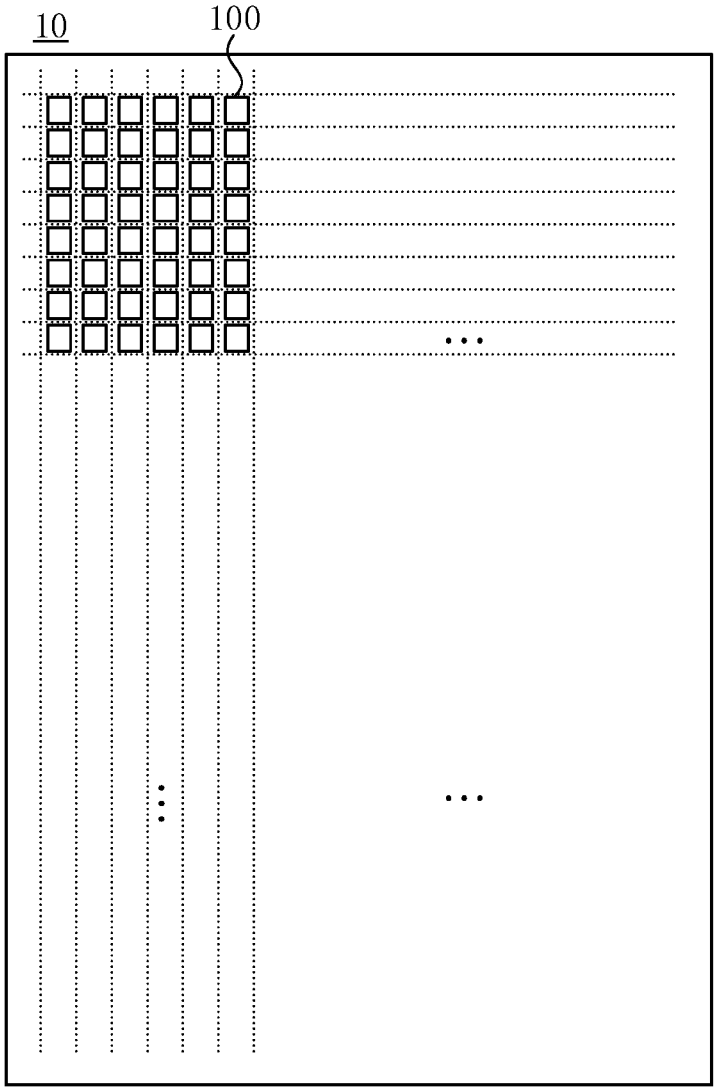
FIG. 4 shows an array substrate according to an embodiment of the present disclosure.
Figure 5:
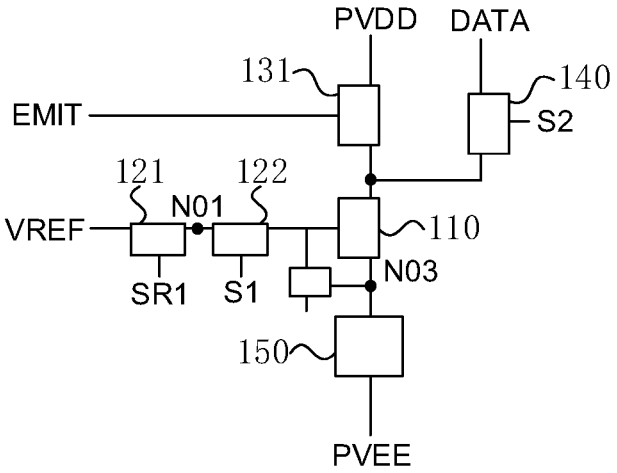
FIG. 5 is a block diagram of a pixel circuit according to an embodiment of the present disclosure.
Figure 6:
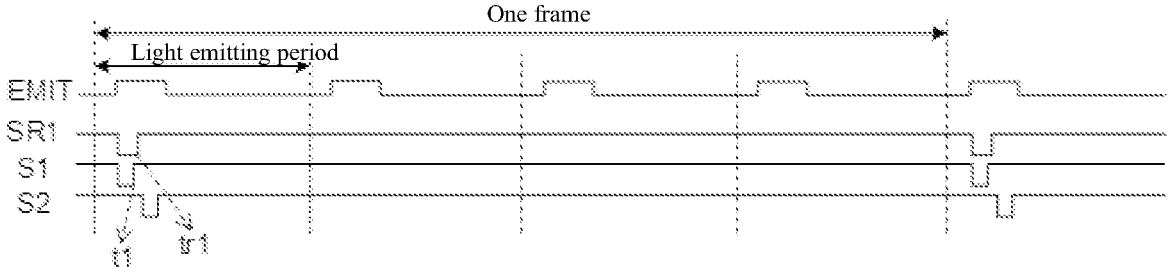
FIG. 6 is a work time sequence of a pixel circuit according to an embodiment of the present disclosure.

Exemplarily, FIG. 4 is a structural diagram of an array substrate according to an embodiment of the present disclosure, FIG. 5 is a structural diagram of a pixel circuit according to an embodiment of the present disclosure, and FIG. 6 is a schematic diagram of a work time sequence of a pixel circuit according to an embodiment of the present disclosure. With reference to FIG. 4 to FIG. 6, the array substrate 10 includes pixel circuits 100 arranged in an array, where each pixel circuit 100 includes a drive module 110, a first initialization module 121, a second initialization module 122, a first light emitting control module 131, a data writing module 140 and a light emitting module 150; the drive module 110 is used for generating a drive current; the first initialization module 121 and the second initialization module 122 are connected in series between an initialization signal terminal VREF and a control terminal of the drive module 110, an output terminal of the second initialization module 122 is electrically connected to the control terminal of the drive module 110, and an output terminal of the first initialization module 121 and an input terminal of the second initialization module 122 each are electrically connected to a first intermediate node N01; the first light emitting control module 131 is used for transmitting a first power signal PVDD to an input terminal of the drive module 110; the data writing module 140 is used for transmitting a data signal Vdata to the input terminal of the drive module 110; the light emitting module 150 is connected in series between the drive module 110 and a second power signal terminal PVEE, a first electrode of the light emitting module 150 is electrically connected to a reset node N03, and a second electrode of the light emitting module 150 is electrically connected to the second power signal terminal PVEE; a control terminal of the first initialization module 121 is used for receiving a first additional scan signal SR1, a control terminal of the second initialization module 122 is used for receiving a first scan signal S1, a control terminal of the first light emitting control module 131 is used for receiving a light emitting control signal EMIT, and a control terminal of the data writing module 140 is used for receiving a second scan signal S2; and within at least one light emitting period of one frame duration, end time of an active level pulse of the first additional scan signal SR1 is later than end time of an active level pulse of the first scan signal S1.

The drive current of the drive module 110 flows through the light emitting module 150 to drive the light emitting module 150 to emit light. One of factors determining a magnitude of the drive current generated by the drive module 110 is the potential of the control terminal of the drive module 110, and the potential of the control terminal is affected by leakage currents of the first initialization module 121 and the second initialization module 122, and further, magnitudes of the leakage currents depend on a potential difference between the first intermediate node N01 and the control terminal of the drive module 110.

Based on this, it is set that within at least one light emitting period of one frame duration, the end time of the active level pulse of the first additional scan signal SR1 is later than the end time of the active level pulse of the first scan signal S1, so that: when the active level of the first scan signal S1 ends, only the second initialization module 122 is turned off, and the first initialization module 121 is still in an on state, and at this time, the potential of the first intermediate node N01 is still kept to a potential of the initialization signal terminal VREF; then, the active level of the first additional scan signal SR1 ends, the first initialization module 121 is turned off, and at this time, the first intermediate node N01 is only coupled one time by the potential of the first additional scan signal SR1 and is not affected by potential variation of the first scan signal S1, so that potential variation of the first intermediate node N01 is smaller, a potential difference between the first intermediate node N01 and the control terminal of the drive module 110 is smaller, the leakage currents of the first initialization module 121 and the second initialization module 122 is smaller, influence on the potential of the control terminal of the drive module 110 is smaller, and further influence on the drive current is smaller, that is, the fluctuation of the drive current is smaller, which is beneficial to alleviating the flicker phenomenon of the light emitting module 150, and is beneficial to improving the image display effect of the display panel and the display device.

The pixel circuit provided by the embodiments of the present disclosure is compared with the pixel circuit in the related art as follows: in the related art, a potential of an intermediate node of a double-gate transistor has a great influence on a leakage current of the control terminal (hereinafter may be simply referred to as "first node") of the drive module; specifically, the higher the potential of the intermediate node of the double-gate transistor is, the larger the leakage current of the double-gate transistor relative to the first node is, and the more obvious the flicker phenomenon is. Referring to FIG. 1, taking the potential variation of the intermediate node of the first double-gate transistor T03 as an example, the influence on the first node will be exemplarily described. Specifically, a total capacitance of the intermediate node of the first double-gate transistor T03 includes a parasitic capacitance Cgs1 of a left-side transistor M5-1, a parasitic capacitance Cgs2 of a right-side transistor M5-2, and other parasitic capacitances of the intermediate node. When the left-side transistor M5-1 and the right-side transistor M5-2 of the first double-gate transistor T03 are turned off simultaneously, the parasitic capacitance Cgs1 of the left-side transistor M5-1, the parasitic capacitance Cgs2 of the right-side transistor M5-2 and the other parasitic capacitances of the intermediate node are coupled simultaneously, and the potential of the intermediate node is pulled up, at this time, the potential of the intermediate node is pulled up significantly and is usually pulled up to a potential close to the potential of the first gate control terminal S01 after S01 leaps and the potential is 3V to 4V higher than the potential of the first node. The reason for the increase of the leakage current caused by the coupling is that: after the intermediate node of the double-gate transistor is pulled high, the leakage current flows to the first node, the higher the potential of the intermediate node is, the larger the leakage current flows to the first node, and the more obvious the flicker is. In the embodiment of the present disclosure, by turning off the second initialization module 122 firstly and then turning off the first initialization module 121, the potential of the first intermediate node N01 is coupled only by the turning off of the first initialization module 121, and the voltage variation caused by the coupling is significantly reduced. Thus, the potential of the first intermediate node N01 (the position corresponding to the potential of the intermediate node of the first double-gate transistor T03) is higher than the potential of the first node by only 1V to 2V, so that the leakage current can be reduced by half, and the flicker phenomenon can be alleviated.

It should be noted that In FIG. 6 and other sequence diagrams provided by embodiments of the present disclosure, only taking that the low level is an active level (may also be referred to as an "enable level") and the high level is an inactive level (may also be referred to as a "disable level") as an example, the drive time sequence of the pixel circuit is described exemplarily. In other embodiments, the high level may be set as an active level and the low level may be set as an inactive level according to requirements of the pixel circuit, which is not limited in the embodiments of the present disclosure.

It should be noted that FIG. 5 only exemplarily shows a partial structure of the pixel circuit related to the improvement point of the present disclosure, and the complete circuit structure of the pixel circuit and the operation principle of the pixel circuit are described in detail below.

Figure 7:
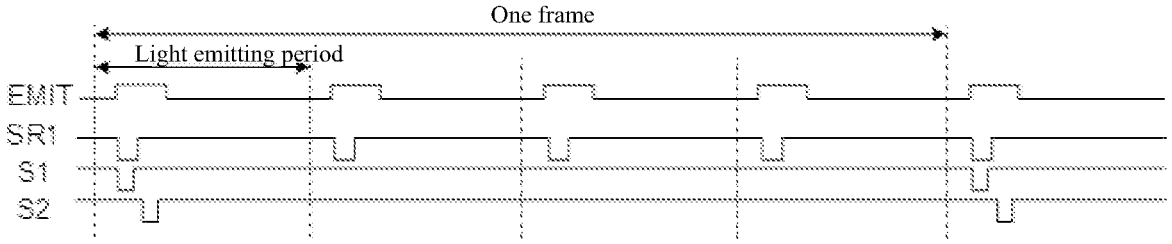
FIG. 7 is another work time sequence of a pixel circuit according to an embodiment of the present disclosure.

In an embodiment, FIG. 7 is a schematic diagram of another work time sequence of a pixel circuit according to an embodiment of the present disclosure. With reference to FIG. 7, an enable frequency of the first additional scan signal SR1 is greater than an enable frequency of the first scan signal S1.

When the first additional scan signal SR1 and the first scan signal S1 are at an active level, the initialization signal of the initialization signal terminal VREF is transmitted to the control terminal of the drive module 110 through the first initialization module 121 and the second initialization module 122, and the control terminal is initialized, so as to ensure that the drive module 110 can normally operate subsequently. When the first additional scan signal SR1 is at an active level and the first scan signal S1 is at a disable level, the first initialization module 121 is turned on and the second initialization module 122 is turned off. By setting that the enable frequency of the first scan additional signal SR1 is greater than the enable frequency of the first scan signal S1, the first initialization module 121 can be turned on while the second initialization module 122 is turned off; at this time, the initialization signal of the initialization signal terminal VREF is transmitted to the first intermediate node N01, equivalently the initialization signal is used to reset the first intermediate node N01, so that the potential of the first intermediate node N01 can be maintained in a relatively stable state, so that a potential difference between the control terminal of the drive module 110 and the first intermediate node N01 is relatively stable, namely a fluctuation of the potential difference is small, so that the potential of the first intermediate node N01 has a small influence on the potential of the control terminal of the drive module 110, and the drive current generated by the drive module 110 has a small fluctuation, and the brightness of the light emitting module 150 has a small variation range, which is beneficial to alleviating the flicker phenomenon.

It should be noted that FIG. 7 exemplarily shows that the enable frequency of the first additional scan signal SR1 is equal to the enable frequency of the light emitting control signal EMIT. By this way, before a light emitting stage of each light emitting period, the potential of the control terminal of the drive module 110 is more uniformly affected by the potential of the first intermediate node N01, which is beneficial to ensuring that the drive current is more uniform, so that a range of the light emitting brightness of the light emitting module 150 smaller, thereby alleviating the flicker phenomenon.

In other embodiments, the enable frequency of the first additional scan signal SR1 may also be set to any other frequency greater than the enable frequency of the first scan signal S1. The enable frequency of the first additional scan signal may be set according to the requirements of the pixel circuit, which is not limited in the embodiments of the present disclosure.

Figure 8:
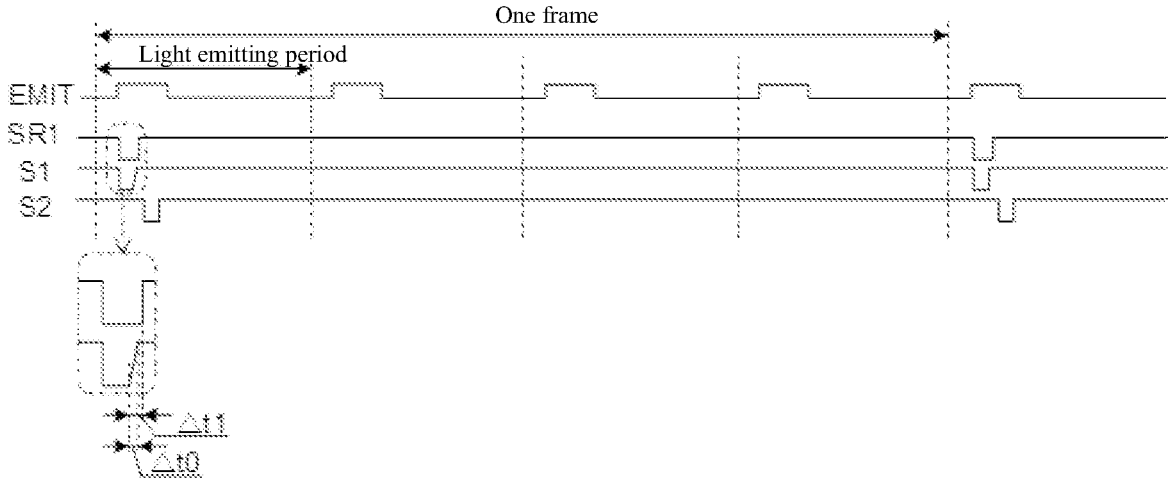
FIG. 8 is another work time sequence of a pixel circuit according to an embodiment of the present disclosure.

In an embodiment, FIG. 8 is a schematic diagram of another work time sequence of a pixel circuit according to an embodiment of the present disclosure.

With reference to FIG. 8, within at least one light emitting period of one frame duration, a duration $\Delta t1$ from the end time of an active level pulse of the first scan signal S1 to the end time of the active level pulse of the first additional scan signal SR1 satisfies: $\Delta t1 \geq \Delta t0$; and $\Delta t0$ is a leap delay duration of the first scan signal.

Within the leap delay duration $\Delta t0$ of the first scan signal S1, the second initialization module 122 gradually turns off from the completely on state, and finally switches to the completely off state. By setting that the duration $\Delta t1$ from the end time of the active level pulse of the first scan signal S1 to the end time of the active level pulse of the first additional scan signal SR1 is greater than or equal to the leap delay duration of the first scan signal S1, when or after the module 122 is completely turned off, the first initialization module 121 starts to be turned off. By this way, it can be ensured that the first intermediate node N01 only couples variation amount of the leap potential of the first additional scan signal SR1 and is not affected by the potential leap of the first scan signal S1, so that the potential coupling amount of the first intermediate node N01 is smaller, which has less influence on the potential of the control terminal of the drive module 150, thereby alleviating the flicker phenomenon.

Exemplarily, a value range of Δt0 may be 0.5 μs≤Δt0≤3 μs. When Δt0=0.5 μs, Δt1 satisfies Δt1≥0.5 μs. In other embodiments, when the value of Δt0 varies, a time range of Δt1 varies accordingly.

It should be noted that FIG. 8 only schematically shows that the potential signal varies linearly within the leap delay duration of the first scan signal S1. In other embodiments, the variation trend within leap delay duration of each signal in the drive time sequence may also be arc-shaped, which is not limited in the embodiments of the present disclosure.

Figure 9:
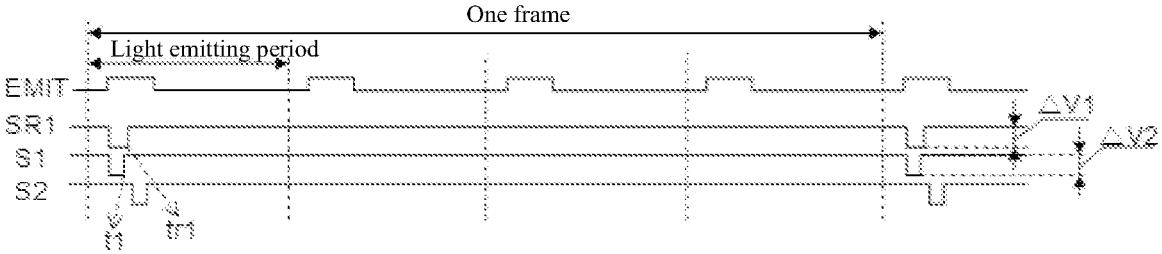
FIG. 9 is another work time sequence of a pixel circuit according to an embodiment of the present disclosure.

In an embodiment, FIG. 9 is a schematic diagram of another work time sequence of a pixel circuit according to an embodiment of the present disclosure. With reference to FIG. 9, a voltage difference ΔV1 between the active level of the first additional scan signal SR1 and an inactive level of the first additional scan signal SR1 and a voltage difference ΔV2 between the active level of the first scan signal S1 and an inactive level of the first scan signal S1 satisfies: ΔV1<ΔV2.

The first additional scan signal SR1 and the first scan signal S1 each are switching control signals. In the related art, the voltage difference between the active level and the inactive level of the two signals may be the same, thereby making the drive time sequence relatively simple while implementing the switching control.

In this embodiment, the smaller the voltage difference ΔV1 between the active level of the first additional scan signal SR1 and the inactive level of the first additional scan signal SR1 is, the smaller the coupling effect on the first intermediate node N01. Therefore, by setting that ΔV1<ΔV2, the coupling of the potential variation of the first additional scan signal SR1 to the first intermediate node N01 can be reduced, thereby alleviating the flicker.

Figure 10:
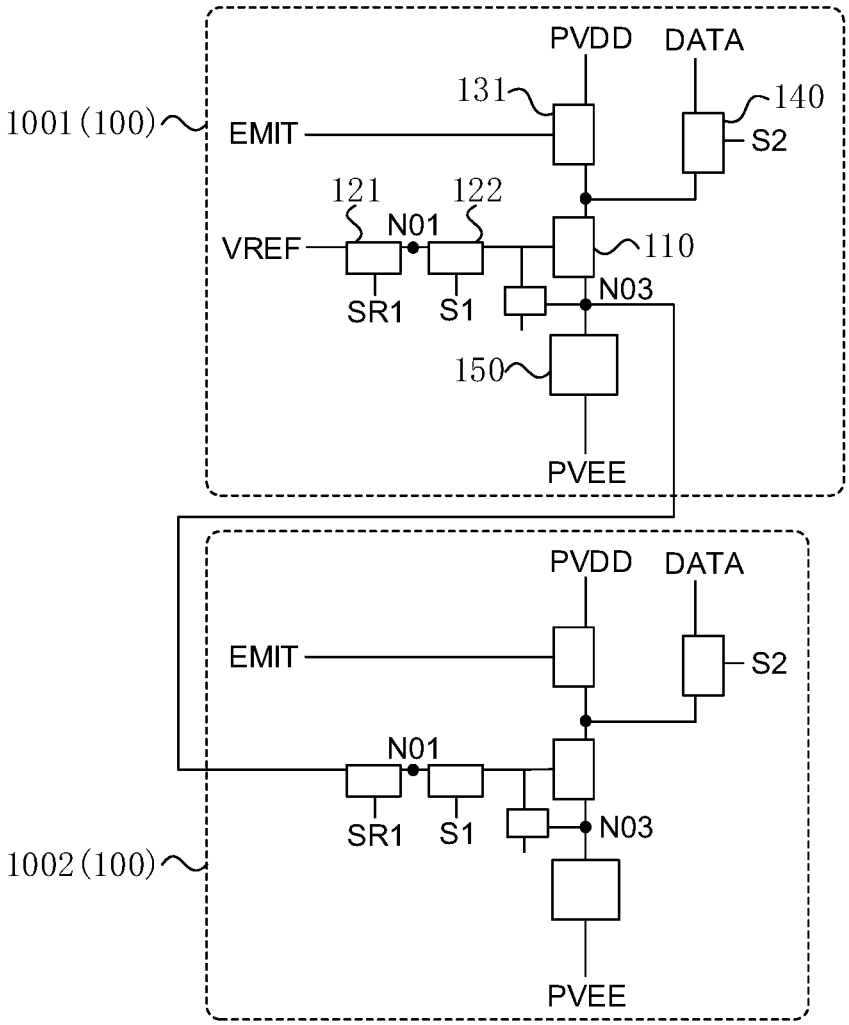
FIG. 10 is a circuit block diagram of another pixel circuit according to an embodiment of the present disclosure.

In an embodiment, FIG. 10 is a schematic diagram of another pixel circuit according to an embodiment of the present disclosure. With reference to FIG. 10, an input terminal of the first initialization module 121 of the pixel circuit 1002 (100) in a current row is electrically connected to the reset node N03 of the pixel circuit 1001 (100) in a previous row.

Such a setting is beneficial to implementing a trace design in the array substrate 10, reduce the difficulty of the trace design and manufacturing, and thereby reducing the cost, which will be described in detail below in conjunction with FIG. 12.

Figure 11:
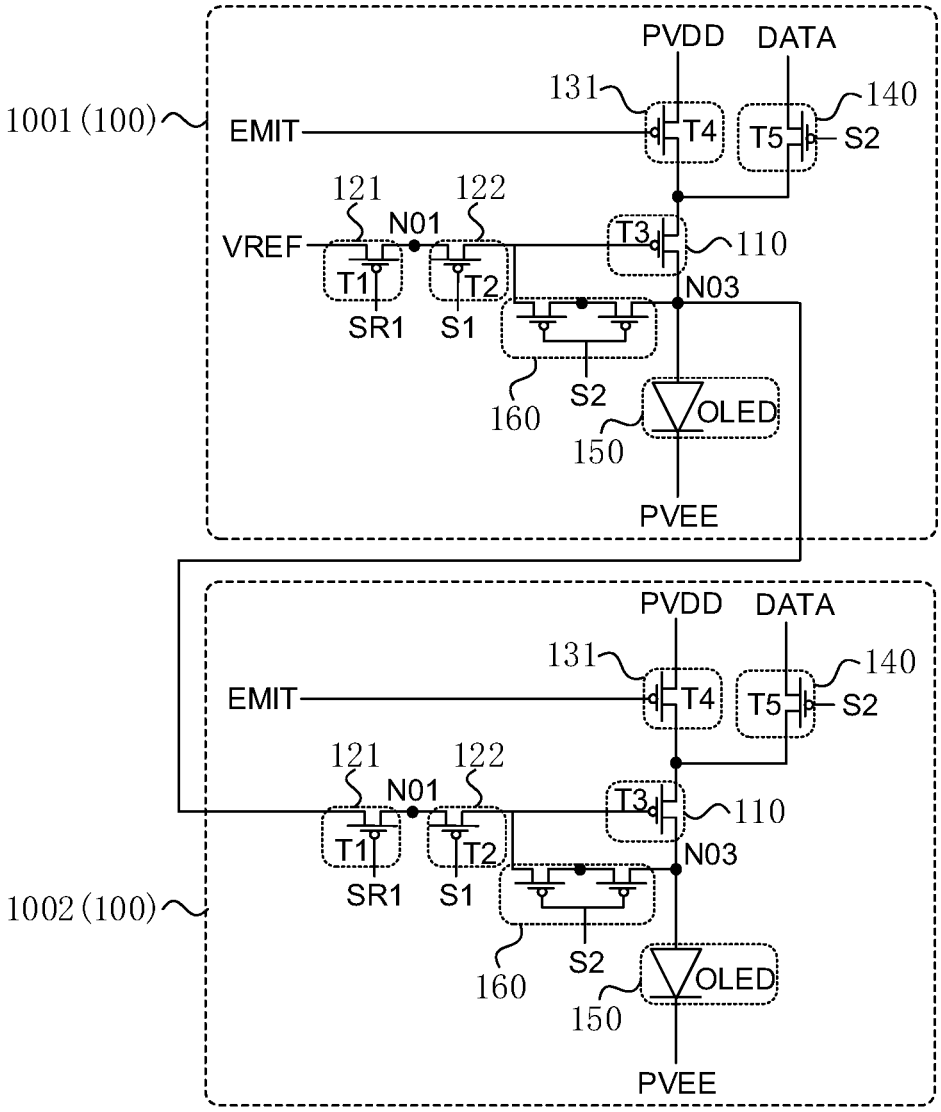
FIG. 11 is a circuit diagram of another pixel circuit according to an embodiment of the present disclosure.

In an embodiment, FIG. 11 is a schematic diagram of another pixel circuit according to an embodiment of the present disclosure. With reference to FIG. 11, the first initialization module 121 includes a first transistor T1, the second initialization module 122 includes a second transistor T2, the drive module 110 includes a third transistor T3, the first light emitting control module 131 includes a fourth transistor T4, the data writing module 140 includes a fifth transistor T5, and the light emitting module 150 includes an organic light emitting diode (OLED).

With this setting, on the basis of implementing functions of the above-mentioned modules, the circuit structure of these modules can be simpler, which is beneficial to saving circuit layout space and reducing manufacturing difficulty and manufacturing cost.

The first transistor T1 may also be referred as a drive transistor, and the second transistor T2, the third transistor T3, the fourth transistor T4, and the fifth transistor T5 each are switch transistors. A gate, a drain and a source of each transistor (including the switch transistor and the light emitting transistor) are respectively used as a control terminal, an input terminal and an output terminal of each module; the transistors coordinately work under the drive time sequence to drive the OLED to emit light. The specific working process will be described below in detail.

It should be noted that, in FIG. 11 and other pixel circuit structural diagrams provided by the embodiments of the present disclosure, it is only exemplarily shown that each transistor is a P-type transistor. In other embodiments, the transistors may also be set to be N-type transistors, and the modules may also be set to other circuit element structures known to those skilled in the art. The transistors and the module may be set according to the requirements of the pixel circuit, which is not limited in the embodiments of the present disclosure.

It should be noted that FIG. 11 also exemplarily shows a threshold compensation module 160. The threshold compensation module 160 is electrically connected between the control terminal and the output terminal of the drive module 110, and an input terminal of the threshold compensation module 160 is electrically connected to the output terminal of the drive module 110, an output terminal of the threshold compensation module 160 is electrically connected to the control terminal of the drive module 110, and an control terminal of the threshold compensation module 160 is used for receiving the second scan signal S2. In a data writing stage, a data signal DATA is written into the control terminal of the drive module 110 through the data writing module 140, the drive module 110, and the threshold compensation module 160. Exemplarily, the threshold compensation module 160 may be a double-gate transistor, as shown in FIG. 11. In other embodiments, the threshold compensation module 160 may also be two single-gate transistors controlled by a same second scan signal S2, which is not limited in the embodiments of the present disclosure.

Figure 12:
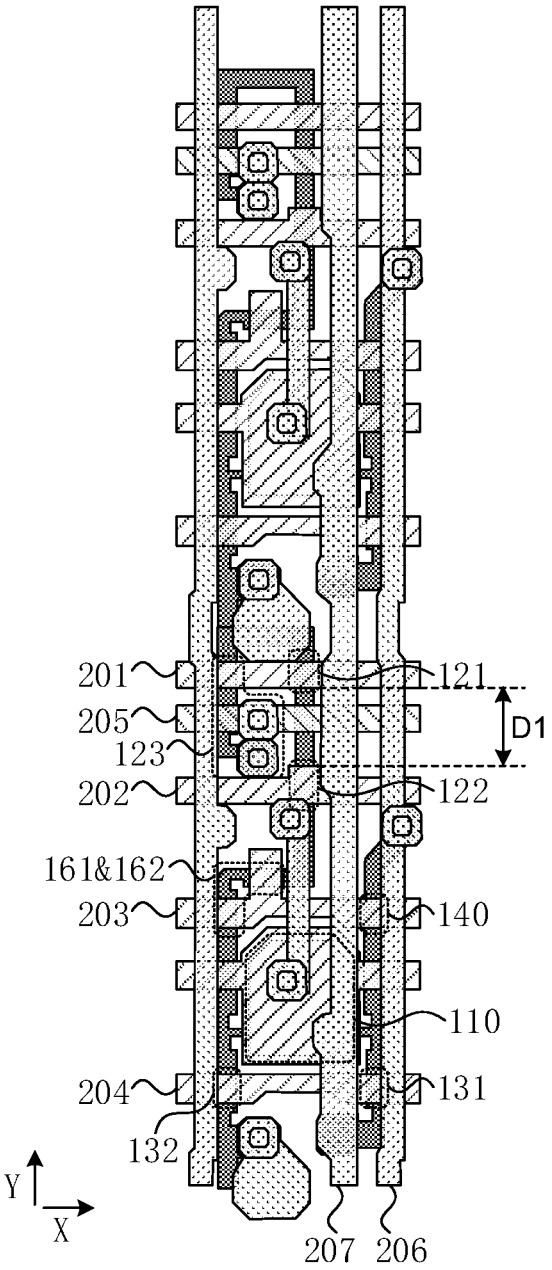
FIG. 12 is a layout diagram of a film layer structure of a pixel circuit according to an embodiment of the present disclosure.

In an embodiment, FIG. 12 is a schematic diagram of a film layer structure of a pixel circuit according to an embodiment of the present disclosure. In conjunction with FIG. 11 and FIG. 12, a width-to-length ratio of a channel region of the second transistor T2 is smaller than a width-to-length ratio of a channel region of the first transistor T1.

The smaller the width-to-length ratio of the channel region of the transistor is, the smaller the leakage current is. The second transistor T2 is connected between the first intermediate node N01 and the control terminal of the drive module 110. The width-to-length ratio of the channel region of the second transistor T2 is set to be relatively small, which is beneficial to reducing the leakage current between the first intermediate node N01 and the control terminal of the drive module 110, thereby reducing the influence of the first intermediate node N01 on the drive current of the drive module and alleviating the flicker phenomenon.

The width-to-length ratio of the channel region of the transistor is a ratio of a width of the channel to a length of the channel. Based on this, in order to implement that the width-to-length ratio of the channel region of the second transistor T2 is smaller than the width-to-length ratio of the channel region of the first transistor T1, it may be set that widths of channels of the two transistors are the same, and a length of a channel of the second transistor T2 is greater than a length of a channel of the first transistor T1; or it may be set that the lengths of the channels of the two transistors are the same, and the width of the channel of the second transistor T2 is smaller than the width of the channel of the first transistor T1; or it may be set that the length of the channel of the second transistor T2 is greater than the length of the channel of the first transistor T1, and meanwhile, the width of the channel of the second transistor T2 is smaller than the width of the channel of the first transistor T1, which is not limited in the embodiments of the present disclosure.

In an embodiment, with continued reference to FIG. 11 and FIG. 12, a distance D1 between a gate of the second transistor T2 and a gate of the first transistor T1 satisfies: D1≥5 μm.

Two sides of the first intermediate node N01 are electrically connected to the first transistor T1 and the second transistor T2 respectively. The parasitic capacitance of the first intermediate node N01 includes not only the parasitic capacitances of the first transistor T1 and the second transistor T2, but also parasitic capacitance caused by the mutual influence between the first transistor T1 and the second transistor T2. Based on this, when the distance between the first transistor T1 and the second transistor T2 is relatively large, the mutual influence between the first transistor T1 and the second transistor T2 can be reduced, which is beneficial to reducing the parasitic capacitance of the first intermediate node N01, thereby reducing the variation of the coupling potential of the first intermediate node N01, reducing the leakage current between the first intermediate node N01 and the control terminal of the drive module 110, and alleviating the flicker phenomenon.

In other embodiments, it may be set that D1=6 μm, or 10 μm≥D1≥5.5 μm, or D1 may be set to be other numerical ranges known to those skilled in the art, which is not limited in the embodiments of the present disclosure.

It can be understood that in a practical product structure, the distance between the gate of the first transistor T1 and the gate of the second transistor T2 may define an extending length of a trace between the channel region of the first transistor T1 and the channel region of the second transistor T2 in an active layer corresponding to the first intermediate node N01.

It should be noted that, in FIG. 12, only the opposite sides of the gates of the two transistors are used as boundaries to define the distance between the gates of the two transistors. In other embodiments, other manners known to those skilled in the art may also be used to define the distance between the gates of the two transistors, which is not limited in the embodiments of the present disclosure.

Figure 13:
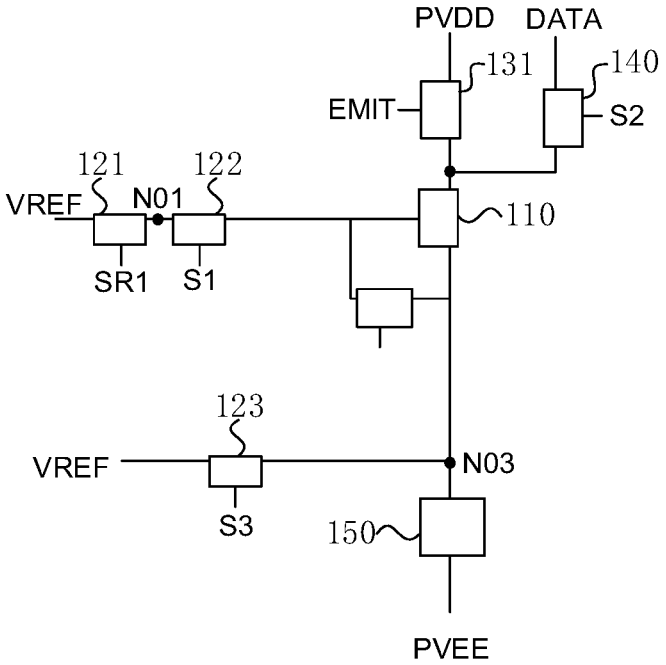
FIG. 13 is a block circuit diagram of another pixel circuit according to an embodiment of the present disclosure.
Figure 14:
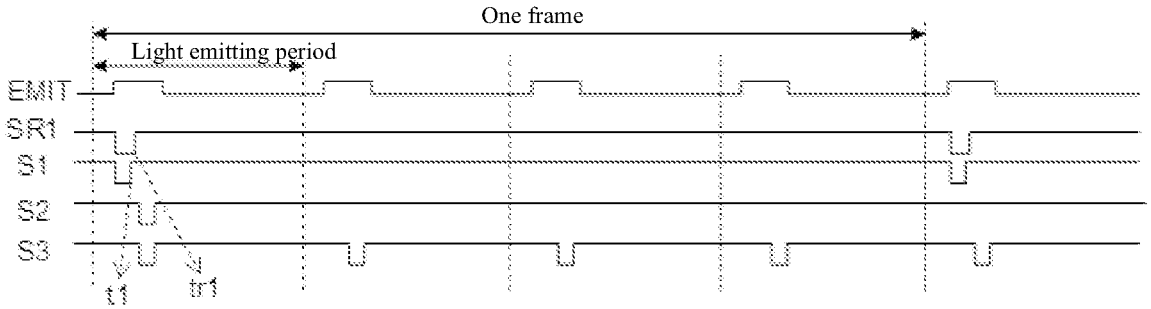
FIG. 14 shows another work time sequence of a pixel circuit according to an embodiment of the present disclosure.

In an embodiment, FIG. 13 is a structural diagram of another pixel circuit according to an embodiment of the present disclosure, and FIG. 14 is a schematic diagram of another work time sequence of a pixel circuit according to an embodiment of the present disclosure. Based on any one of the pixel circuits and the drive time sequences provided in the above embodiments, referring to FIG. 13 and FIG. 14, the pixel circuit may further include a third initialization module 123; an output terminal of the third initialization module 123 is electrically connected to the first electrode of the light emitting module 150, a control terminal of the third initialization module 123 is used for receiving a third scan signal S3, and an input terminal of the third initialization module 123 is electrically connected to the initialization signal terminal VREF; an enable frequency of the third scan signal S3 is greater than an enable frequency of the first scan signal S1.

The third initialization module 123 is used for resetting the first electrode of the light emitting module 150. Exemplarily, when the light emitting module 150 is an OLED, the third initialization module 123 is used for resetting an anode of the OLED, and the enable frequency of the third scan signal S3 is also a reset frequency of the anode of the OLED.

In conjunction with FIG. 1 to FIG. 3, analysis of the cause of the flicker phenomenon shows that by increasing the reset frequency of the first electrode of the light emitting module 150, the light emitting module can be completely turned off multiple times within one frame duration. Before the light emitting module 150 is turned on, the capacitor of the light emitting module 150 needs to be charged, which is beneficial to reducing the brightness difference of the light emitting module 150 in different light emitting durations, thereby alleviating the flicker phenomenon.

In addition, within a first light emitting period of one frame duration, the enable level period of the third scan signal S3 may coincide with the enable level period of the second scan signal S2. In this way, the data writing stage of the light emitting module coincides with the initialization stage of the light emitting module with the light emitting period. A duration occupied by the non-light emitting stage in the light emitting period is shorten while simplifying the sequence signal control manner, which is beneficial to extending the duration of the light emitting stage, avoid the flicker, and ensure a better display effect.

In an embodiment, with continued reference to FIG. 14, the enable frequency of the third scan signal S3 is equal to an enable frequency of the light emitting control signal EMIT.

With this setting, the light emitting module 150 may be completely turned off before the light emitting stage of each light emitting period, which is beneficial to implementing that the brightness curve of turning of each light emitting control signal EMIT is basically the same, so that the human eye cannot recognize the flicker, thereby solving the flicker phenomenon.

Specifically, taking that the light emitting module 150 is an OLED as an example, in conjunction with the OLED reset process and OLED light emitting process, the alleviation of the flicker phenomenon is analyzed as follows: when the third scan signal S3 is in the active level period, the initialization signal terminal VREF may transmit an initialization signal Vref to the anode of the OLED, the initialization signal may be a low level signal.

Based on this, the OLED is reset using the initialization signal Vref Based on this, the light emitting process of the OLED is that the low-potential initialization signal Vref causes the anode of the OLED to quickly become a negative potential, the OLED is turned off, and at this time, the OLED does not emit light at all. When the light emitting control signal EMIT is turned on, firstly the capacitor of the OLED needs to be charged, and the anode potential of the OLED gradually rises, the anode potential of the OLED can only reach the normal light emitting potential after a period of time; at this time, the light emitting brightness of the OLED reaches its normal light emitting brightness. In general, using the initialization signal Vref to reset the anode potential of the OLED can cause that the OLED is completely turned off, the OLED light emitting time is delayed, and the OLED stays in a dark state for longer time.

In a hold frame in the idle mode, that is, in a process of only using the light emitting control signal EMIT to turn off the OLED and turn on the OLED, that the light emitting control signal EMIT turns off the OLED is essentially only to cut off a path of the current between the first power signal PVDD and the second power signal terminal PVEE, at this time, the existence of other leakage currents will cause the OLED to still have a certain brightness, that is, the OLED is not turned off completely. When the light emitting control signal EMIT enables again, because there is no initializing signal Vref to reset the anode of the OLED, the anode potential of the OLED still maintains the potential when the OLED emits light previously. Therefore, when the light emitting control signal EMIT enables, the OLED will rapidly start emitting light, that is, the time that the OLED is in the dark state is relatively short, and the brightness when the OLED is in the dark state is not black enough.

In conjunction with the above, it can be seen from a frame-maintaining brightness curve (that is, the brightness variation curve) in the related art that: among the brightness curves L01, L02, and L03, there is a very low-brightness valley in every four downward valleys. The low-brightness valley corresponds to the initialization signal Vref to reset the OLED, and the other three high-brightness valleys may correspond to the light emitting control signal EMIT to turn off the OLED. Since the low valley brightness is a low frequency (for example, 15 Hz frequency) brightness reduction, the human eye can recognize this phenomenon. In this embodiment, the OLED is reset by the initialization signal Vref while the light emitting control signal EMIT is set to be disabled, the pull-down low valley will appear at a high frequency (for example, a frequency of 60 Hz), and the human eye cannot recognize the brightness variation at this frequency, thereby implementing the alleviation of the flicker phenomenon.

In addition, the time sequence setting manner may be made simpler; at the same time, a same time sequence control circuit may be used to provide the third scan signal S3 and the light emitting control signal EMIT meanwhile. The circuit structure is relative simple, which is beneficial to decreasing the difficulty of designing and manufacturing the array substrate and to reduce the cost.

Figure 15:
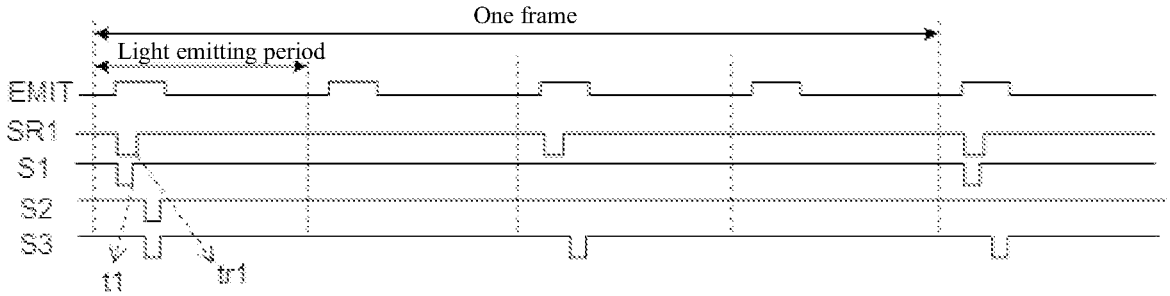
FIG. 15 shows another work time sequence of a pixel circuit according to an embodiment of the present disclosure.

In an embodiment, FIG. 15 is a schematic diagram of another work time sequence of a pixel circuit according to the embodiment of the present disclosure. With reference to FIG. 15, an enable frequency of the third scan signal S3 is equal to an enable frequency of the first additional scan signal SR1.

By this setting, the time sequence setting manner may be made simpler while alleviating the flicker phenomenon; at the same time, a same time sequence control circuit may be used to provide the third scan signal S3 and the first additional scan signal SR1 at the same time. The circuit structure is relative simple, which is beneficial to decreasing the difficulty of designing and manufacturing the array substrate and to reduce the cost.

Based on FIG. 14 and FIG. 15, a relationship among the reset frequency of the OLED anode, the enable frequency of the light emitting control signal EMIT, the enable frequency of the first additional scan signal SR1, and the brightness flicker frequency (also referred to "the dimming frequency") of the light emitting module 150 will be described exemplarily.

The reset frequency of the OLED anode is equal to or greater than the dimming frequency. Exemplarily, when the dimming frequency is 15 Hz, the reset frequency of the OLED may be 60 Hz, 120 Hz, 180 Hz, 240 Hz or higher. Meanwhile, the enable level period of the first additional scan signal SR1 is within the disable level period of the light emitting control signal EMIT, and the enable frequency of the first additional scan signal SR1 is equal to or smaller than the enable frequency of the light emitting control signal EMIT. When no brightness flicker exists, the reset frequency of the OLED anode may be relatively low, such as 30 Hz, and the first additional scan signal SR1 may use the same frequency to reduce energy consumption.

In addition, since the human eye's recognizability of brightness flicker below 30 Hz is significantly increased, the reset frequency of the OLED anode may be set to be higher than 30 Hz, otherwise the flicker alleviation effect is not significant. At the same time, under different data refresh frequencies, such as 1 Hz and 60 Hz, 60 Hz may be used to reset the anode of the OLED. In this case, the first additional scan signal SR1 may have a same width of active level under the two different data refresh frequencies.

In other embodiments, based on the above-mentioned frequency setting manner, the above-mentioned frequencies may also be set to other frequency values known to those skilled in the art and the above-mentioned frequencies may be set according to the requirements of the array substrate, which is not limited in the embodiments of the present disclosure.

Figure 16:
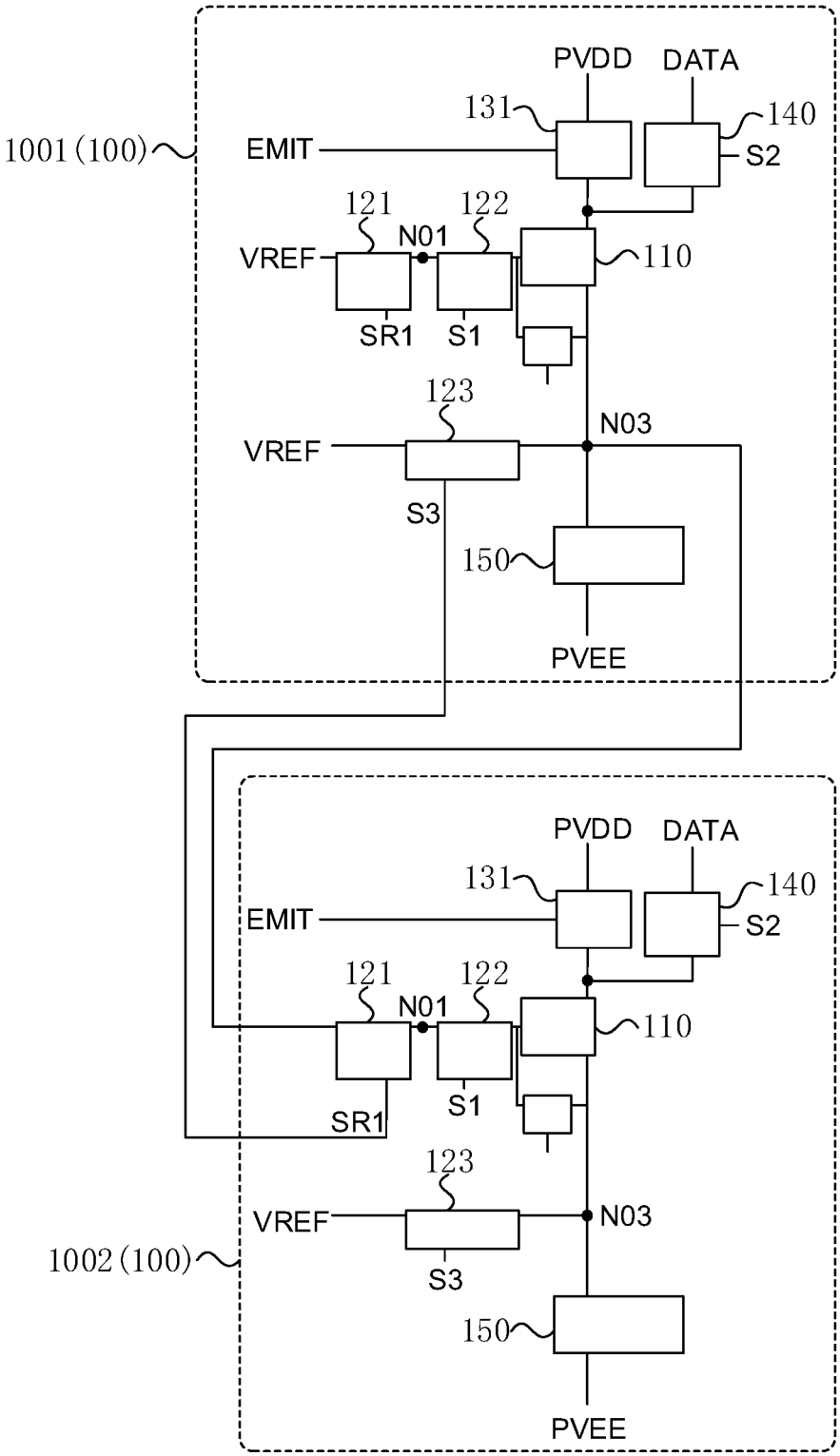
FIG. 16 is a circuit block diagram of another pixel circuit according to an embodiment of the present disclosure.

In an embodiment, FIG. 16 is a schematic diagram of another pixel circuit according to an embodiment of the present disclosure. On the basis of FIG. 13 and FIG. 15, referring to FIG. 12 and FIG. 16, the first additional scan signal SR1 of the pixel circuit 1002 (100) in the current row and the third scan signal S3 of the pixel circuit 1001 (100) in the previous row are of a same time sequence.

The first additional scan signal SR1 of the pixel circuit 1002 (100) in the current row and the third scan signal S3 of the pixel circuit 1001 (100) in the previous row may be provided by a same scan line (hereinafter "first scan line 201"). In this way, by designing the film pattern in the array substrate, the above-mentioned connection relationship may be implemented by a relatively simple trace manner, thereby simplifying the trace connection manner.

Figure 17:
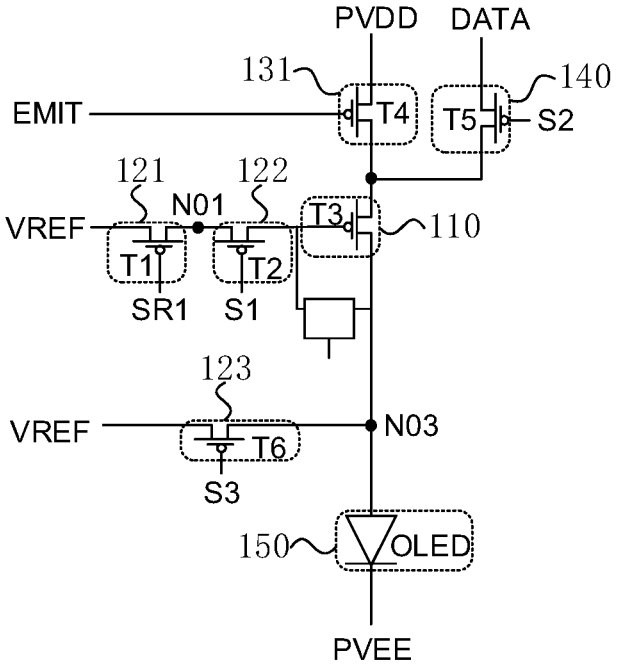
FIG. 17 is a circuit diagram of another pixel circuit according to an embodiment of the present disclosure.

In an embodiment, FIG. 17 is a schematic diagram of another pixel circuit according to an embodiment of the present disclosure. With reference to FIG. 17, the third initialization module includes a sixth transistor T6.

The sixth transistor T6 is a switch transistor, which is used for turning on or turning off under the control of the third scan signal S3, so as to reset the anode of the OLED. At the same time, such a setting can make the circuit structure of the third initialization module 123 relatively simple, which is beneficial to ensuring lower manufacturing difficulty and product cost.

Figure 18:
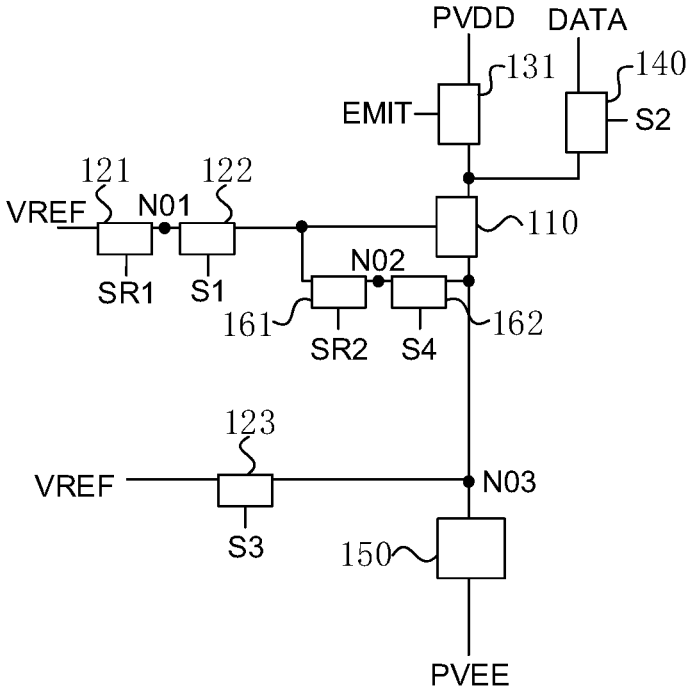
FIG. 18 is a circuit diagram of another pixel circuit according to an embodiment of the present disclosure.
Figure 19:
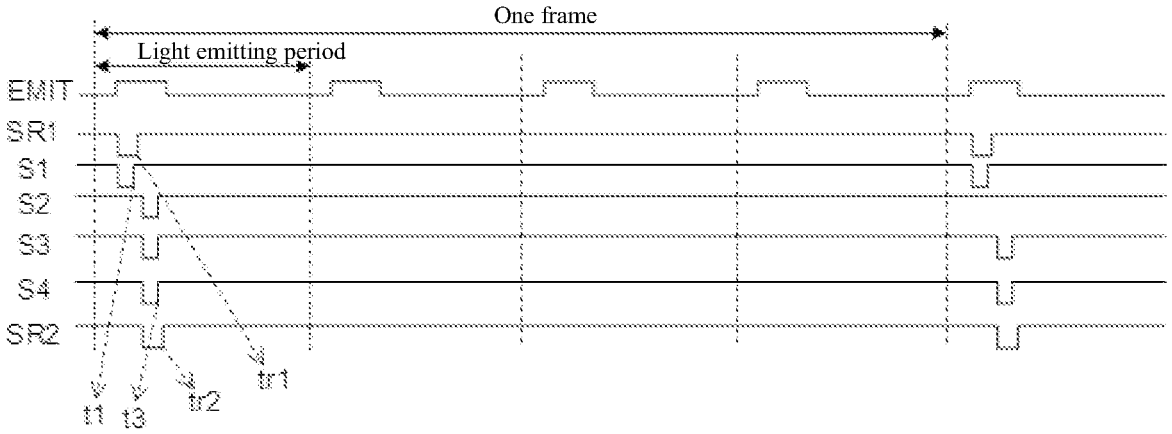
FIG. 19 shows another work time sequence of a pixel circuit according to an embodiment of the present disclosure.

In an embodiment, FIG. 18 is a structural diagram of another pixel circuit according to an embodiment of the present disclosure, and FIG. 19 is a schematic diagram of another work time sequence of a pixel circuit according to an embodiment of the present disclosure. With reference to FIG. 18 and FIG. 19, the pixel circuit may further include a first threshold compensation module 161 and a second threshold compensation module 162; the first threshold compensation module 161 and the second threshold compensation module 162 are connected in series between the control terminal of the drive module 110 and an output terminal of the drive module 110, an output terminal of the first threshold compensation module 161 is electrically connected to the control terminal of the drive module 110, an input terminal of the second threshold compensation module 162 is electrically connected to the output terminal of the drive module 110, and an input terminal of the first threshold compensation module 161 and an output terminal of the second threshold compensation module 162 each are electrically connected to a second intermediate node N02; a control terminal of the first threshold compensation module 161 is used for receiving a second additional scan signal SR2, and a control terminal of the second threshold compensation module 162 is used for receiving a fourth scan signal S4; within at least one light emitting period of one frame duration, end time tr2 of an active level pulse of the second additional scan signal SR2 is later than end time t3 of an active level pulse of the fourth scan signal S4, as shown in FIG. 19; or within at least one light emitting period of one frame duration, the end time of the active level pulse of the second additional scan signal SR2 is synchronized with the end time of the active level pulse of the fourth scan signal S4, which is not show in the figures.

On the basis of the improved manner shown in FIG. 4 to FIG. 17, if the flicker phenomenon has been significantly alleviated, it may be set that within at least one light emitting period of one frame duration, the end time of the active level pulse of the second additional scan signal SR2 is synchronized with the end time of the active level pulse of the fourth scan signal S4, thereby simplifying the drive time sequence.

In another embodiment, it may also be set that within at least one light emitting period of one frame duration, the end time tr2 of the active level pulse of the second additional scan signal SR2 is later than the end time t3 of the active level pulse of the fourth scan signal S4. By this setting, the first threshold compensation module 161 and the second threshold compensation module 162, which are simultaneously electrically connected to the second intermediate node N02, can be not turned off at the same time. In this way, the potential variation of the second intermediate node N02 will be reduced to the amount of coupling caused by the potential variation of the control terminal of the first threshold compensation module 161. Thus, compared to the amount of coupling caused by the potential variation of the control terminal of a double-gate transistor which is coupled by the second intermediate node N02 in the related art, the amount of coupling of the second intermediate node N02 is reduced. Therefore, the leakage current between the second intermediate node N02 and the control terminal of the drive module 110 will be reduced, and the influence on the control terminal of the drive module 110 will be relatively small, and the fluctuation of the drive current will be relatively small, which is beneficial to alleviating the flicker phenomenon.

Similar to the above-mentioned related time sequence improvement of the first intermediate node N01, the duration of the end time of the active level pulse of the second additional scan signal SR2 being later than the end time of the active level pulse of the fourth scan signal S4 may be set to be equal to or greater than the leap delay duration of the fourth scan signal S4; the voltage difference between the active level and the inactive level of the second additional scan signal SR2 may also be set to be smaller than the voltage difference between the active level and the inactive level of the fourth scan signal, and the relevant principles can be refer to the above explanations for understanding, which will not be repeated here.

Figure 20:
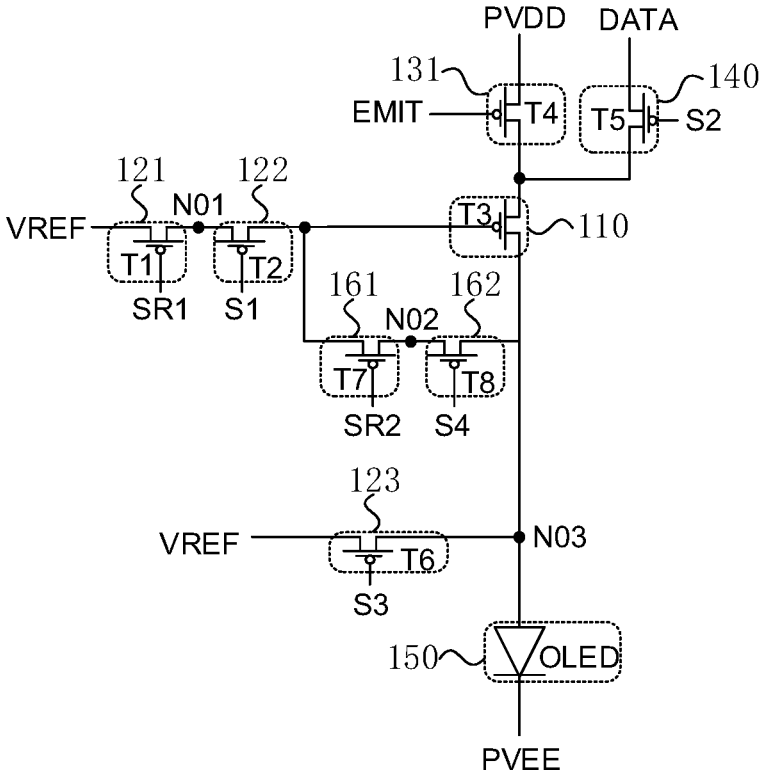
FIG. 20 is a circuit diagram of another pixel circuit according to an embodiment of the present disclosure.

In an embodiment, FIG. 20 is a schematic diagram of another pixel circuit according to an embodiment of the present disclosure. With reference to FIG. 18 and FIG. 20, the first threshold compensation module 161 includes a seventh transistor T7 and the second threshold compensation module 162 includes an eighth transistor T8.

The seventh transistor T7 and the eighth transistor T8 each are switch transistors. The seventh transistor T7 and the eighth transistor T8 cooperate with the above-mentioned transistors to implement the light emitting module 150 to emit light. At the same time, such a setting can make the circuit structures of the first threshold compensation module 161 and the second threshold compensation module 162 relatively simple, which is beneficial to ensuring lower manufacturing difficulty and product cost.

In an embodiment, with continued reference to FIG. 12 and FIG. 20, a width-to-length ratio of a channel region of the seventh transistor T7 is smaller than a width-to-length ratio of a channel region of the eighth transistor T8.

Similar to the above, the smaller the width-to-length ratio of the channel region of the transistor is, the smaller the leakage current is. Based on this, by setting the width-to-length ratio of the channel region of the transistor (that is, the seventh transistor T7) connected between the control terminal of the drive module 110 and the second intermediate node N02 to be relatively small, the leakage current between the second intermediate node N02 and the control terminal of the drive module 110 can be reduced, thereby reducing the influence of the potential of the second intermediate node N02 on the potential of the control terminal of the drive module 110, which is beneficial to reducing the fluctuation of the drive current and alleviate the flicker phenomenon.

Similar to implementing the relative relationship of the width-to-length ratio mentioned above, in order to implement that the width-to-length ratio of the channel region of the seventh transistor T7 is smaller than the width-to-length ratio of channel region of the eighth transistor T8, it may be set that the widths of the channels of the two transistors are the same, the length of the channel of the seventh transistor T7 is greater than the length of the channel of the eighth transistor T8; or it may be set that the lengths of the channels of the two transistors are the same, and the width of the channel of the seventh transistor T7 is smaller than the width of the channel of the eighth transistor T8; or it may be set that the length of the channel of the seventh transistor T7 is greater than the length of the channel of the eighth transistor T8, while the width of the channel of the seventh transistor T7 is smaller than the width of the channel of the eighth transistor T8.

In other embodiments, other manners known to those skilled in the art may also be used to implement that the leakage current of the second initialization module 122 is smaller than the leakage current of the first initialization module 121, and/or implement that the leakage current of the first threshold compensation module 161 is smaller than the leakage current of the second threshold compensation module 162, which is not limited in the embodiments of the present disclosure.

In an embodiment, with continued to reference to FIG. 12, the pixel circuit further includes a first scan line 201, a second scan line 202, a third scan line 203, a light emitting control line 204, a reset line 205, a data line 206, a first potential line 207, and a second potential line layer (not shown); the first scan line 201, the reset line 205, the second scan line 202, the third scan line 203 and the light emitting control line 204 extend along a first direction X and are sequentially arranged along a second direction Y; the first potential line 207 and the data line 206 extend along the second direction Y and are sequentially arranged along the first direction X; the second potential line layer is distributed over an entire surface; and the control terminal of the first initialization module 121 of the pixel circuit 100 in a current row and the control terminal of the third initialization module 123 of a respective pixel circuit 100 in a previous row are electrically connected to a same first scan line 201; the input terminal of the third initialization module 123 is electrically connected to the reset line 205; the control terminal of the second initialization module 122 is electrically connected to the second scan line 202; the control terminal of the first threshold compensation module 161 and the control terminal of the second threshold compensation module 162 are electrically connected to the third scan line 203; the control terminal of the first light emitting control module 131 is electrically connected to the light emitting control line 204, an input terminal of the first light emitting control module 131 is electrically connected to the first potential line 207; an input terminal of the data writing module 140 is electrically connected to the data line 206; and the second electrode of the light emitting module 150 is electrically connected to the second potential line layer.

The first scan line 201, the second scan line 202, the third scan line 203, and the light emitting control line 204 each are all used for providing gate control signals (also referred to as "switching control signals") to control function modules electrically connected to them respectively in the on state or in the off state.

Exemplarily, the first scan line 201 may provide the first additional scan signal SR1 to the current row and the third scan signal S3 to the previous row, the second scan line 202 may provide the first scan signal S1, and the third scan line 203 may provide the second scan signal S2 and the light emitting control line 204 may provide the light emitting control signal EMIT.

The reset line 205, the data line 206, the first potential line 207, and the second potential line layer each are all used for providing a constant potential signal. Exemplarily, the reset line 205 may provide an initialization signal to the initialization signal terminal VREF, and the data line 206 may provide a data signal, and the data signal may pass through the data writing module 140, the second threshold compensation module 162, and the first threshold compensation module 161 and may be written to the control terminal of the drive module 110; the first potential line 207 may provide the first power signal, and the second potential line layer may be used as the second power signal terminal to provide the second power signal; exemplarily, the first power signal is higher than the second power signal, so that a potential difference between the two terminals of the light emitting module 150 exists, the drive current may flow through the light emitting module 150, and the light emitting module 150 may be driven to emit light.

In this way, at the trace layout level of the circuit layer, in order to implement that the input terminal of the first initialization module 121 in the current row is electrically connected to the reset node N03 in the previous row, and the first initialization module 121 in the current row and the third initialization module 123 in the previous row are provided the gate control signal by a same first scan line 201, the third initialization module 123 in the previous row and the first initialization module 121 in the current row may be centrally arranged in a same region and switch under the control of a same first scan line 201 extending along a horizontal direction. In this way, a cross-line design is not required. While implementing the connection relationship of the pixel circuit, a number of traces can be reduced, making the trace manner simple and easy to implement.

Figure 21:
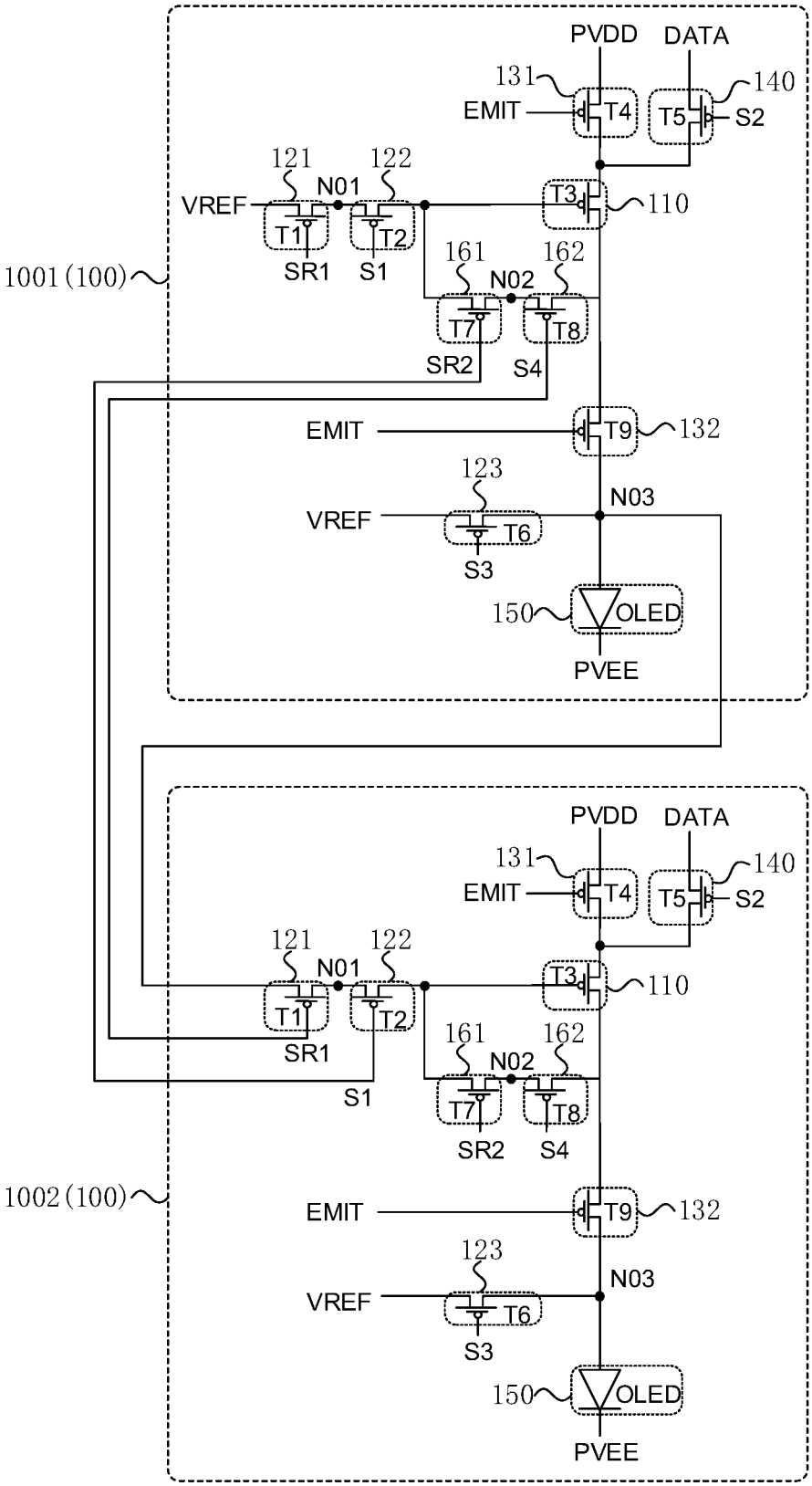
FIG. 21 is a circuit diagram of another array substrate according to an embodiment of the present disclosure.

In an embodiment, FIG. 21 is a structural diagram of another array substrate according to an embodiment of the present disclosure, the structure may be obtained by changing the trace manner based on FIG. 12. On the basis of FIG. 12, with continued to reference to FIG. 21, the pixel circuit further includes a first scan line 201, a second scan line 202, a light emitting control line 204, a reset line 205, a data line 206, a first potential line 207, and a second potential line layer; the first scan line 201, the reset line 205, the second scan line 202, and the light emitting control line 204 extend along a first direction X and are sequentially arranged along a second direction Y; the first potential line 207 and the data line 206 extend along the second direction Y and are sequentially arranged along the first direction X; the second potential line layer is distributed over an entire surface; and the control terminal of the first initialization module 121 of the pixel circuit 100 in a current row, the control terminal of the third initialization module 123 of a respective pixel circuit 100 in a previous row, and the control terminal of the first threshold compensation module 161 of the respective pixel circuit 100 in the previous row are electrically connected to a same first scan line 201; the control terminal of the second initialization module 122 of the pixel circuit 100 in the current row and the control terminal of the second threshold compensation module 162 of the respective pixel circuit 100 in the previous row are electrically connected to a same second scan line 202; the input terminal of the third initialization module 123 is electrically connected to the reset line 205; the control terminal of the first light emitting control module 131 is electrically connected to the light emitting control line 204; an input terminal of the first light emitting control module 131 is electrically connected to the first potential line 207, an input terminal of the data writing module 140 is electrically connected to the data line 206; and the second electrode of the light emitting module 150 is electrically connected to the second potential line layer.

The trace manner is similar to the trace manner shown in FIG. 12 and will not be repeated herein; the difference is that: firstly, the module with threshold compensation function no longer uses double-gate transistor (shown as "161&162" in FIG. 12), but uses two independently controlled single-gate transistors, that is, the seventh transistor T7 and the eighth transistor T8; based on this, the second additional scan signal SR2 of the pixel circuit in the previous row may be reused as the first additional scan signal SR1 of the pixel circuit in the current row, and the fourth scan signal S4 of the pixel circuit in the previous row may be reused as the first scan signal S1 of the pixel circuit in the current row. Based on this, the first scan line 201 is used for providing the second additional scan signal SR2 of the pixel circuit in the previous row and the first additional scan signal SR1 of the pixel circuit in the current row, and the second scan line 202 is used for providing the fourth scan signal S4 of the pixel circuit in the previous row and the first scan signal S1 of the pixel circuit in the current row, and may be used for providing the third scan signal S3 of the pixel circuit in the previous row.

Such a setting is beneficial to simplifying the drive time sequence and reducing the number of traces, thereby reducing an area of the array substrate occupied by the traces, facilitating to reserve more area for the light emitting module 150, further increasing the pixel density and improving the image display effect.

In other embodiments, on the premise of satisfying the above-mentioned module functions and drive time sequence, the trace manner may be set to be other trace manners known to those skilled in the art, which is not limited in the embodiments of the present disclosure.

Figure 22:
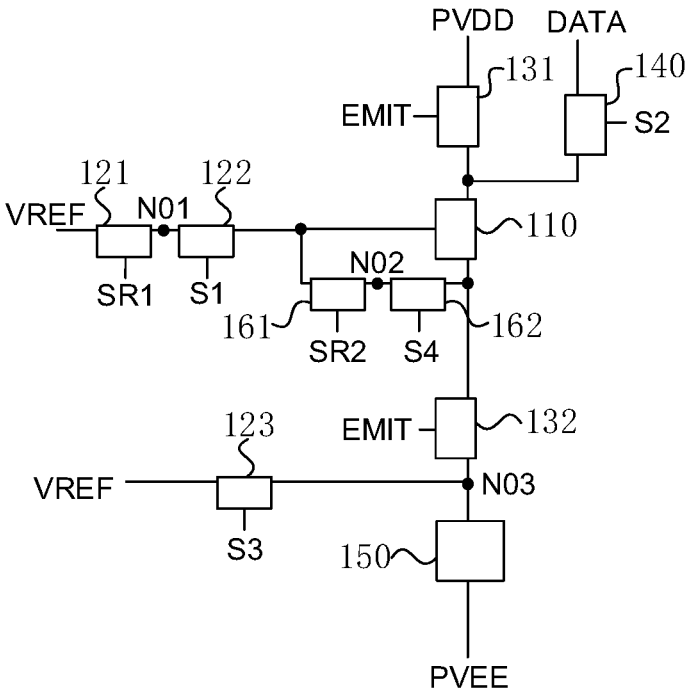
FIG. 22 is a circuit diagram of another pixel circuit according to an embodiment of the present disclosure.

In an embodiment, FIG. 22 is a schematic diagram of another pixel circuit according to an embodiment of the present disclosure. On the basis of FIG. 18, with reference to FIG. 22, the pixel circuit further includes a second light emitting control module 132; the control terminal of the second light emitting control module 132 is used for receiving the light emitting control signal EMIT; an input terminal of the second light emitting control module 132 is electrically connected to an output terminal of the drive module 110, and an output terminal of the second light emitting control module 132 is electrically connected to the reset node N03.

The second lighting control module 132 is electrically connected between the drive module 110 and the lighting emitting module 150. When the first lighting emitting control module 131 and the second light emitting control module 132 are turned on at the same time, the drive current generated by the drive module 110 flows through the light emitting module 150 and the light emitting module 150 is driven to emit light. Setting the second light emitting control module 132 is beneficial to ensuring that: after the third initialization module 123 resets the first electrode of the light emitting module 150, and the potential of the reset node N03 keeps stable, thereby avoiding the light emitting module 150 emitting undesired light.

Figure 23:
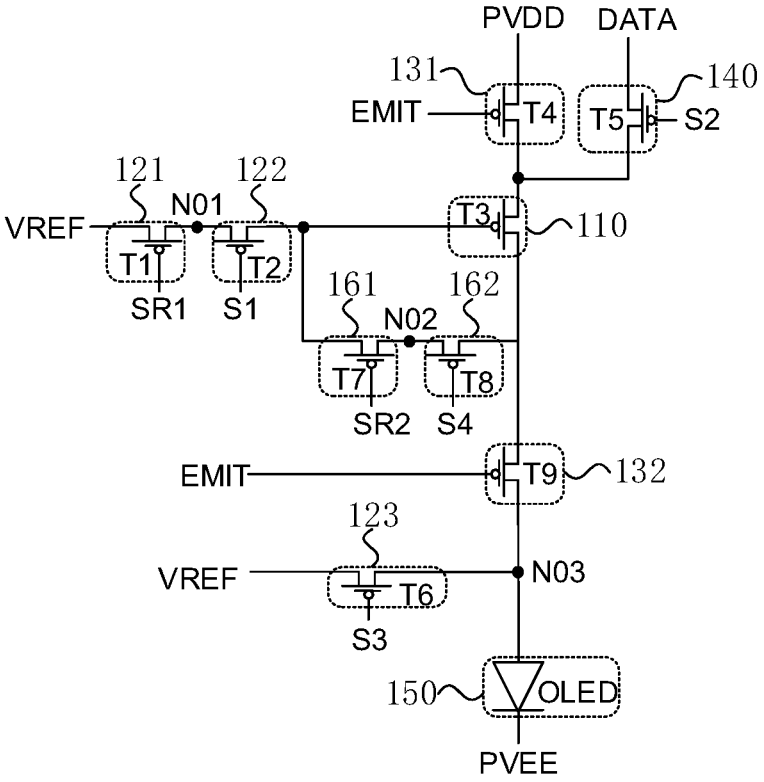
FIG. 23 is a structural diagram of another pixel circuit according to an embodiment of the present disclosure.

In an embodiment, FIG. 23 is a schematic diagram of another pixel circuit according to an embodiment of the present disclosure. In conjunction with FIG. 22 and FIG. 23, the second light emitting control module 132 includes a ninth transistor T9.

The ninth transistor T9 is a switch transistor. Such a setting can make the circuit structure of the second light emitting control module 132 simple, which is beneficial to saving space, and at the same time ensuring that the array substrate has lower manufacturing difficulty and lower manufacturing cost.

Figure 24:
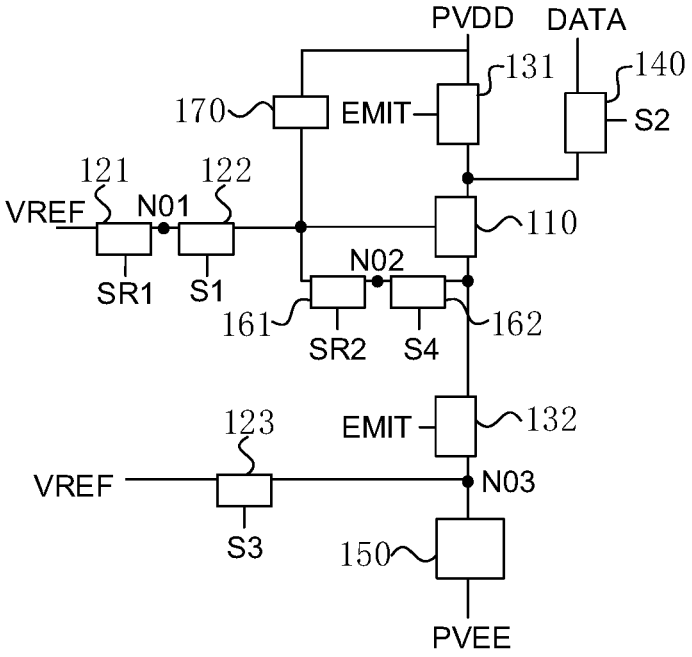
FIG. 24 is a circuit diagram of another pixel circuit according to an embodiment of the present disclosure.

In an embodiment, FIG. 24 is a schematic diagram of another pixel circuit according to an embodiment of the present disclosure. On the basis of FIG. 22, with reference to FIG. 24, the pixel circuit further includes a storage module 170; a first terminal of the storage module 170 is electrically connected to the control terminal of the drive module 110, and a second terminal of the storage module 170 is electrically connected to an input terminal of the first light emitting control module 131.

The storage module 170 is used for maintaining a voltage of the control terminal of the drive module 110, exemplarily, for maintaining a gate voltage of the drive transistor; the drive module 110 generates a drive current to drive the light emitting module 150 to continuously emit light.

Figure 25:
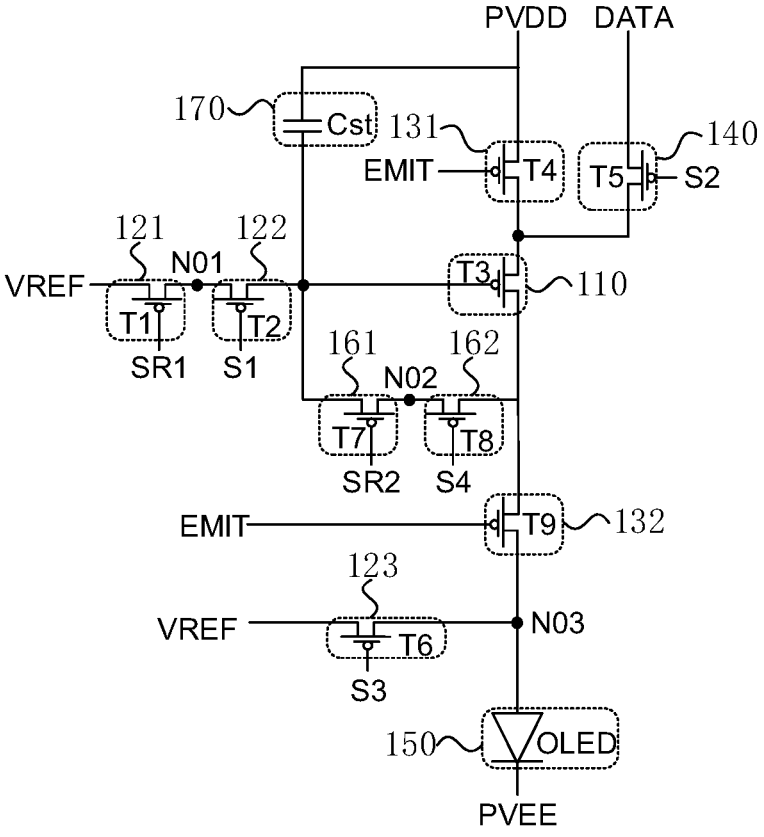
FIG. 25 is a circuit diagram of another pixel circuit according to an embodiment of the present disclosure.

In an embodiment, FIG. 25 is a schematic diagram of another pixel circuit according to an embodiment of the present disclosure. In conjunction with FIG. 24 and FIG. 25, the storage module 170 includes a storage capacitor Cst.

Such a setting can make the circuit structure of the storage module 170 simple, which is beneficial to saving space, and at the same time ensuring that the array substrate has lower manufacturing difficulty and lower manufacturing cost.

Taking FIG. 25 as an example, the working principle of the array substrate provided by the embodiment of the present disclosure is described exemplarily. One frame duration may include multiple light emitting periods, and the first light emitting period may include an initialization stage, a data writing stage, and a light emitting stage which are executed sequentially.

During the initialization stage, the first additional scan signal SR1 and the first scan signal S1 are low, the first transistor T1 and the second transistor T2 are turned on, and the initialization signal of the initialization signal terminal VREF is transmitted to the gate of the third transistor T3 through the first transistor T1 and the second transistor T2.

Then, the first scan signal S1 leaps to high, and the second transistor T2 is turned off; after the second transistor T2 is completely turned off, the first additional scan signal SR1 leaps to high, and the first transistor T1 is turned off.

During the data writing stage, the second scan signal S2, the third scan signal S3, the fourth scan signal S4, and the second additional scan signal SR2 each are low, the fifth transistor T5, the sixth transistor T6, and the seventh transistor T7 and the eighth transistor T8 is turned on; at the same time, a low-level initialization signal is written into the gate of the third transistor T3 in the initialization stage, and the third transistor T3 is turned on. Based on this, the initialization signal of the initialization signal terminal VREF is transmitted to the reset node N03 through the sixth transistor T6; the data signal DATA is written to the gate of the third transistor T3 through the second transistor T2, the eighth transistor T8 and the seventh transistor T7, the gate potential of the third transistor T3 gradually increases until the third transistor T3 is turned off. At this time, the gate voltage of the third transistor T3 satisfies: is the voltage value of the data signal DATA, and is The threshold voltage of the third transistor T3.

Then, the second scan signal S2, the third scan signal S3, and the fourth scan signal S4 leap to high, the fifth transistor T5, the sixth transistor T6, and the eighth transistor T8 are turned off; after the eighth transistor T8 is completely turned off, the second additional scanning signal SR2 leaps to high, and the seventh transistor T7 is turned off.

During the light emitting stage, the light emitting control signal EMIT is low, the fourth transistor T4 and the ninth transistor T9 are turned on, and the leakage current $I_d$ of the third transistor T3, that is, the drive current, drives the OLED to emit light through the ninth transistor T9. The drive current $I_d$ satisfies:

$$I_d = \frac{1}{2}\mu C_{ox}\frac{W}{L}(V_{gs} - V_{th})^2 = \frac{1}{2}\mu C_{ox}\frac{W}{L}(V_1 - V_{PVDD} - V_{th})^2 = \frac{1}{2}\mu C_{ox}\frac{W}{L}(V_{data} + V_{th} - V_{PVDD} - V_{th})^2 = \frac{1}{2}\mu C_{ox}\frac{W}{L}(V_{data} - V_{PVDD})^2, \quad \text{a.}$$

μ is the carrier mobility of the third transistor T3, W is the width of the channel of the third transistor T3 and L is the length of the channel of the third transistor T3, and $C_{ox}$ is the capacitance of the gate oxide layer per unit area of the third transistor T3. $V_{PVDD}$ is the voltage value of the first power signal. It can be seen that the drive current $I_d$ generated by the third transistor T3 is irrelevant to the threshold voltage $V_{th}$ of the third transistor T3. The abnormal display caused by the drift of the threshold voltage of the third transistor T3 is solved. In addition, during the light emitting stage, the third transistor T3 works in the complete cut-off region, so that the characteristic drift degree of the third transistor T3 can be reduced, and the third transistor T3 works in the complete cut-off region in a partial stage of one frame, which is beneficial to reducing display Mura and sticking image, and improving the image display quality.

Meanwhile, compared with the related art in which the charges at the intermediate nodes of the double-gate transistors are accumulated through the coupling of the double gates, in the embodiment of the present disclosure, the module having the initialization function and the threshold compensation function for the gate of the third transistor is set as two independent single-gate transistors and the time sequences of the two independent single-gate transistors are independently controlled, so that the two independent single-gate transistors are not turned off at the same time, the coupling amount between the first intermediate node and the second intermediate node can be reduced, thereby reducing the leakage current between the first intermediate node and the gate of the third transistor T3 and the leakage current between the second intermediate node and the gate of the third transistor T3, and significantly reducing the flicker phenomenon.

Thereafter, in a light emitting period after the first light emitting period within one frame duration, the data is no longer refreshed, and the executable actions include at least one of: resetting the first intermediate node, resetting the OLED anode and resetting the second intermediate node, thereby further alleviating the flicker phenomenon.

On the basis, each gate control signal may be reused between adjacent rows, so that the initialization stages, the data writing stages and the light emitting stages of the pixel circuits in the adjacent rows can overlap in time, which is beneficial to shortening the interval between emitting light of the light emitting modules in the pixel circuits in the adjacent rows, thereby improving the display effect.

On the basis of the above embodiments, an embodiment of the present disclosure further provides a display panel including any one array substrate provided by the above embodiment of the present disclosure. Therefore, when the display panel is driven to display image, the flicker phenomenon is alleviated, and the image display effect is better.

Figure 26:
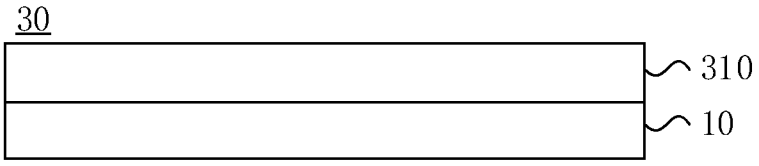
FIG. 26 is a side view of a display panel according to an embodiment of the present disclosure.

By way of example, FIG. 26 is a structural diagram of a display panel according to an embodiment of the present disclosure. With reference to FIG. 26, the display panel 30 may further include a package structure 310 for packaging the array substrate 10, and the package structure 310 may be used for blocking water and oxygen to slow down the film performance attenuation, increasing the stability of the display panel 30, and extending life of the display panel 30. Exemplarily, the package structure 310 may be a package substrate or a thin film package layer.

In other embodiments, the display panel may further include other functional components or structural components known by those skilled in the art, which is neither described nor limited in the embodiments of the present disclosure.

On the basis of the above embodiments, an embodiment of the present disclosure further provides a display device, and the display device may include the display panel provided by the above embodiments. Therefore, when the display device is driven to display image, the flicker phenomenon is alleviated, and the image display effect is better.

Figure 27:
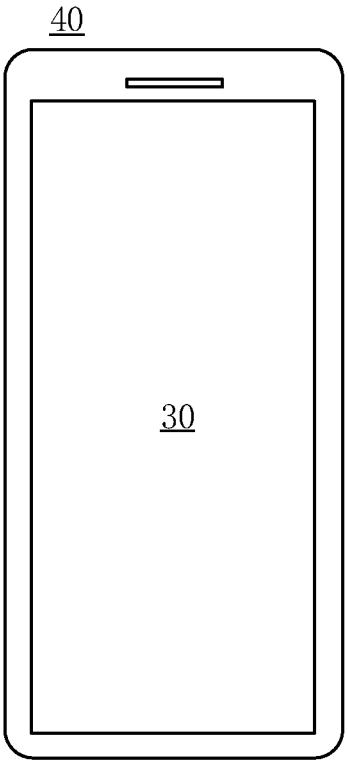
FIG. 27 is a top view of a display device according to embodiments of the present disclosure.

Exemplarily, FIG. 27 is a structure diagram of a display device according to an embodiment of the present disclosure. With reference to FIG. 27, the display device 40 includes the display panel 30. Exemplarily, the display device 40 may be a mobile phone. In other embodiments, the display device may also be a computer, a smart wearable device (such as a smart watch), a vehicle-mounted display screen, a vehicle-mounted touch screen, or other types of electronic devices known to those skilled in the art, or a device or a component having a display function, which is neither described nor limited in the embodiments of the present disclosure.

In other embodiments, the display panel may further include a flexible printed circuit board, a system chip, and other functional components or structural components known by those skilled in the art, which is neither described nor limited in the embodiments of the present disclosure.

On the basis of the above embodiments, an embodiment of the present disclosure further provides a driving method for an array substrate. The driving method can be used for driving any one array substrate provided in the above embodiments to improving the display flicker phenomenon, that is, the driving method also has the beneficial effects of the pixel circuit provided in the above embodiments, and the same points can be understood with reference to the explanation of the pixel circuit above and are not described again in detail below.

Figure 28:
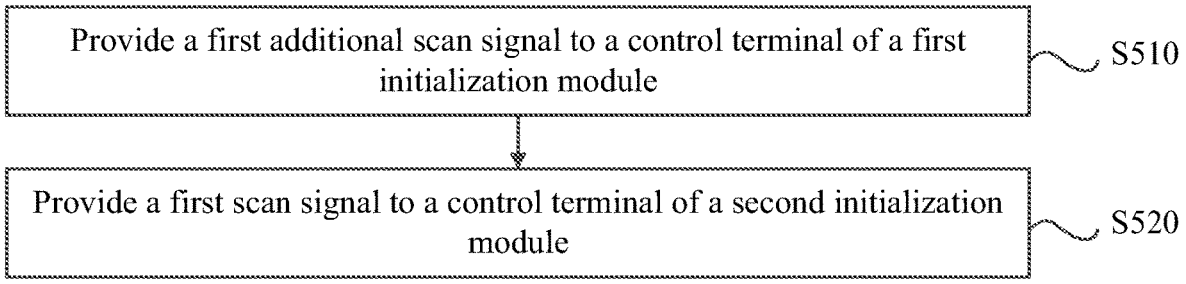
FIG. 28 is a flowchart of a driving method of an array substrate according to an embodiment of the present disclosure.

Exemplarily, FIG. 28 is a flowchart illustrating a method for driving an array substrate according to an embodiment of the present disclosure. Referring to FIG. 28, the driving method includes the steps described below.

In S510, a first additional scan signal is provided to the control terminal of the first initialization module.

Exemplarily, in conjunction with FIG. 5 and FIG. 11, this step may include providing the first additional scan signal SR1 to the gate of the first transistor T1.

In S520, a first scan signal is provided to the control terminal of the second initialization module.

Exemplarily, in conjunction with FIG. 5 and FIG. 11, this step may include providing the first scan signal S1 to the gate of the second transistor T2.

Within at least one light emitting period of one frame duration, end time of an active level pulse of the first additional scan signal is later than end time of an active level pulse of the first scan signal, as shown in any one of FIG. 6 to FIG. 9.

By this setting, the amount of coupling of the first intermediate node N01 can be reduced, thereby alleviating the flicker phenomenon.

Figure 29:
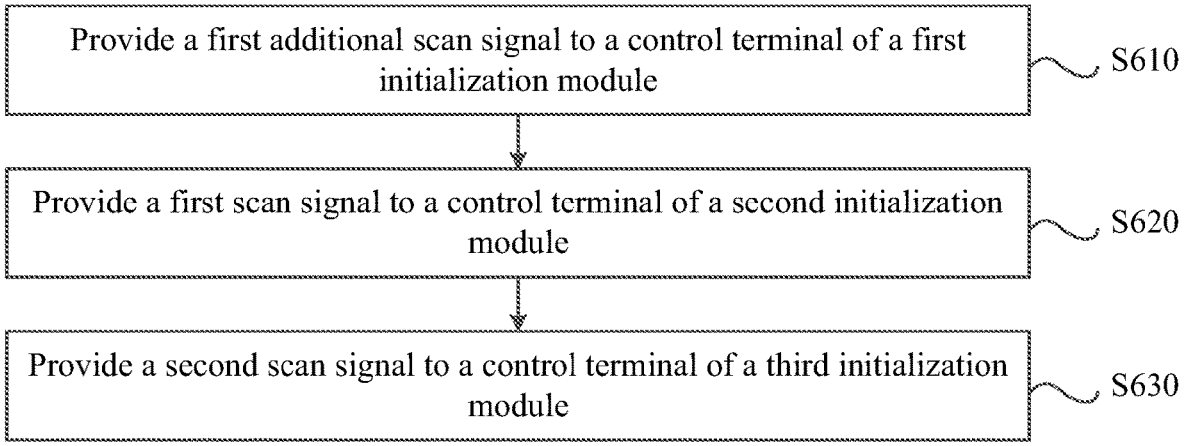
FIG. 29 is a flowchart of a driving method of another array substrate according to an embodiment of the present disclosure.

In an embodiment, with continued reference to FIG. 13, the pixel circuit further includes a third initialization module. Based on this, FIG. 29 is a flowchart of a driving method of another array substrate according to an embodiment of the present disclosure. Referring to FIG. 29, the driving method includes the steps described below.

In S610, a first additional scan signal is provided to the control terminal of the first initialization module.

In S620, a first scan signal is provided to the control terminal of the second initialization module.

In S630, a second scan signal is provided to the control terminal of the third initialization module.

Exemplarily, in conjunction with FIG. 13 and FIG. 17, this step may include providing the third scan signal S3 to the gate of the sixth transistor T6.

The enable frequency of the second scan signal is greater than the enable frequency of the first scan signal, as shown in FIG. 14 or FIG. 15.

By this setting, when data is refreshed at low frequency, the OLED anode may be reset at high frequency, so that the flicker phenomenon caused by low reset frequency can be alleviated.

In an embodiment, with continued reference to FIG. 18, the pixel circuit further includes a first threshold compensation module and a second threshold compensation module. Based on this, the driving method further includes steps described below The second additional scan signal is provided to the first threshold compensation module and the fourth scan signal is provided to the second threshold compensation module.

Exemplarily, in conjunction with FIG. 18 and FIG. 20, this step may include steps described below: the second additional scan signal SR2 is supplied to the gate of the seventh transistor T7, and the fourth scan signal is supplied to the gate of the eighth transistor T8.

Within at least one light emitting period of one frame duration, end time of an active level pulse of the second additional scan signal is later than end time of an active level pulse of the fourth scan signal, as shown in FIG. 19.

By this setting, the amount of coupling of the second intermediate node N02 can be reduced, thereby alleviating the flicker phenomenon.

According to the driving method of the pixel circuit provided by the embodiment of the present disclosure, based on the fact that the first initialization transistor and the second initialization transistor in the pixel circuit are respectively and independently controlled, the first threshold compensation module and the second threshold compensation module are respectively and independently controlled, and the control time sequence may be set to be off at different times, so that the amount of coupling of the first intermediate node and the second intermediate node corresponding to the level leap can be reduced, which is beneficial to reducing the leakage current between the first intermediate node and the control terminal of the drive module and the leakage current between the second intermediate node and the control terminal of the drive module, thereby alleviating the flicker phenomenon. Meanwhile, the first electrode reset frequency of the light emitting module is set to be higher, so that the time interval of brightness variation is smaller, the trend of brightness variation is more consistent, human eyes cannot distinguish brightness variation, and flicker can be alleviated.

It is to be noted that the above are only some embodiments of the present disclosure and the technical principles used therein. It will be understood by those skilled in the art that the present disclosure is not limited to the specific embodiments described herein. Those skilled in the art can make various apparent modifications, adaptations, combinations and substitutions without departing from the scope of the present disclosure. Therefore, while the present disclosure has been described in detail through the above-mentioned embodiments, the present disclosure is not limited to the above-mentioned embodiments and may include more other equivalent embodiments without departing from the concept of the present disclosure. The scope of the present disclosure is determined by the scope of the appended claims.

What is claimed is:

1. A display panel, comprising:

an array substrate, wherein the array substrate comprises a plurality of pixel circuits arranged in an array, wherein each of the plurality of pixel circuits comprises a drive module, a first initialization module, a second initialization module, a first light emitting control module, a data writing module and a light emitting module;

wherein the drive module is configured to generate a drive current;

wherein the first initialization module and the second initialization module are connected in series between an initialization signal terminal and a control terminal of the drive module;

wherein an output terminal of the second initialization module is electrically connected to the control terminal of the drive module, and an output terminal of the first initialization module and an input terminal of the second initialization module each is electrically connected to a first intermediate node;

wherein the first light emitting control module is configured to transmit a first power signal to an input terminal of the drive module;

wherein the data writing module is configured to transmit a data signal to the input terminal of the drive module;

wherein the light emitting module is connected in series to the drive module and a second power signal terminal, a first electrode of the light emitting module is electrically connected to a reset node, and a second electrode of the light emitting module is electrically connected to the second power signal terminal;

wherein a control terminal of the first initialization module is configured to receive a first additional scan signal, a control terminal of the second initialization module is configured to receive a first scan signal, a control terminal of the first light emitting control module is configured to receive a light emitting control signal, and a control terminal of the data writing module is configured to receive a second scan signal; and wherein within at least one light emitting period of one frame duration, an end time of an active level pulse of the first additional scan signal is later than an end time of an active level pulse of the first scan signal.

2. The display panel of claim 1, wherein an input terminal of the first initialization module of each of the plurality of pixel circuits in a current row is electrically connected to the reset node of a respective ones of the plurality of pixel circuits in a previous row.

3. The display panel of claim 1, wherein an enable frequency of the first additional scan signal is greater than an enable frequency of the first scan signal.

4. The display panel of claim 1, wherein within the at least one light emitting period of the frame duration, a duration $\Delta t1$ from the end time of an active level pulse of the first scan signal to the end time of the active level pulse of the first additional scan signal satisfies:

$$\Delta t1 \geq \Delta t0;$$

wherein $\Delta t0$ is a leap delay duration of the first scan signal.

5. The display panel of claim 1, wherein a voltage difference $\Delta V1$ between the active level of the first additional scan signal and an inactive level of the first additional scan signal and a voltage difference $\Delta V2$ between the active level of the first scan signal and an inactive level of the first scan signal satisfies:

$$\Delta V1 < \Delta V2.$$

6. The display panel of claim 1, wherein the first initialization module comprises a first transistor, the second initialization module comprises a second transistor, the drive module comprises a third transistor, the first light emitting control module comprises a fourth transistor, the data writing module comprises a fifth transistor, and the light emitting module comprises an organic light emitting diode; and wherein a width-to-length ratio of a channel region of the second transistor is smaller than a width-to-length ratio of a channel region of the first transistor.

7. The display panel according to claim 6, wherein a distance D1 between a gate of the second transistor and a gate of the first transistor satisfies:

$D1 \geq 5\ \mu m$.

8. The display panel of claim 1, wherein each of the plurality of pixel circuits further comprises a third initialization module;

wherein an output terminal of the third initialization module is electrically connected to the first electrode of the light emitting module, a control terminal of the third initialization module is configured to receive a third scan signal, and an input terminal of the third initialization module is electrically connected to the initialization signal terminal; and wherein an enable frequency of the third scan signal is greater than an enable frequency of the first scan signal.

9. The display panel of claim 8, wherein the enable frequency of the third scan signal is equal to an enable frequency of the light emitting control signal; or wherein the enable frequency of the third scan signal is equal to an enable frequency of the first additional scan signal.

10. The display panel of claim 8, wherein the first additional scan signal of each of the plurality of pixel circuits in a current row and the third scan signal of a respective one of the plurality of pixel circuits in a previous row are of a same time sequence.

11. The display panel of claim 8, wherein the third initialization module comprises a sixth transistor.

12. The display panel of claim 8, wherein each of the plurality of pixel circuits further comprises a first threshold compensation module and a second threshold compensation module;

wherein the first threshold compensation module and the second threshold compensation module are connected in series to the control terminal of the drive module and an output terminal of the drive module;

wherein an output terminal of the first threshold compensation module is electrically connected to the control terminal of the drive module, an input terminal of the second threshold compensation module is electrically connected to the output terminal of the drive module, and an input terminal of the first threshold compensation module and an output terminal of the second threshold compensation module each are electrically connected to a second intermediate node;

wherein a control terminal of the first threshold compensation module is configured to receive a second additional scan signal, and a control terminal of the second threshold compensation module is configured to receive a fourth scan signal;

wherein within the at least one light emitting period of the frame duration, an end time of an active level pulse of the second additional scan signal is later than an end time of an active level pulse of the fourth scan signal; or wherein within the at least one light emitting period of the frame duration, the end time of the active level pulse of the second additional scan signal is synchronized with the end time of the active level pulse of the fourth scan signal.

13. The display panel of claim 12, wherein the first threshold compensation module comprises a seventh transistor, and the second threshold compensation module comprises an eighth transistor; wherein a width-to-length ratio of a channel region of the seventh transistor is smaller than a width-to-length ratio of a channel region of the eighth transistor.

14. The display panel of claim 12, wherein the each pixel circuit further comprises a first scan line, a second scan line, a third scan line, a light emitting control line, a reset line, a data line, a first potential line, and a second potential line layer;

wherein the first scan line, the reset line, the second scan line, the third scan line and the light emitting control line extend along a first direction and are sequentially arranged along a second direction;

wherein the first potential line and the data line extend along the second direction and are sequentially arranged along the first direction; the second potential line layer is distributed over an entire surface; and wherein the control terminal of the first initialization module of the each pixel circuit in the current row and the control terminal of the third initialization module of a respective pixel circuit in a previous row are electrically connected to a same first scan line;

wherein the input terminal of the third initialization module is electrically connected to the reset line;

wherein the control terminal of the second initialization module is electrically connected to the second scan line; the control terminal of the first threshold compensation module and the control terminal of the second threshold compensation module are electrically connected to the third scan line;

wherein the control terminal of the first light emitting control module is electrically connected to the light emitting control line, wherein an input terminal of the first light emitting control module is electrically connected to the first potential line;

wherein an input terminal of the data writing module is electrically connected to the data line; and wherein the second electrode of the light emitting module is electrically connected to the second potential line layer.

15. The display panel of claim 12, wherein each of the plurality of pixel circuits further comprises a first scan line, a second scan line, a light emitting control line, a reset line, a data line, a first potential line, and a second potential line layer;

wherein the first scan line, the reset line, the second scan line, the third scan line the third scan line and the light emitting control line extend along a first direction and are sequentially arranged in parallel along a second direction;

wherein the first potential line and the data line extend along the second direction and are sequentially arranged parallel along the first direction;

wherein the second potential line layer is distributed over a surface; and wherein the control terminal of the first initialization module of each of the plurality of pixel circuits in the current row, the control terminal of the third initialization module of a respective pixel circuit in a previous row, and the control terminal of the first threshold compensation module of the respective pixel circuit in the previous row are electrically connected to a same first scan line;

wherein the control terminal of the second initialization module of the pixel circuit in the current row and the control terminal of the second threshold compensation module of the respective pixel circuit in the previous row are electrically connected to a same second scan line;

wherein the input terminal of the third initialization module is electrically connected to the reset line;

wherein the control terminal of the first light emitting control module is electrically connected to the light emitting control line;

wherein an input terminal of the first light emitting control module is electrically connected to the first potential line, an input terminal of the data writing module is electrically connected to the data line; and wherein the second electrode of the light emitting module is electrically connected to the second potential line layer.

16. The display panel of claim 1, wherein the each pixel circuit further comprises a second light emitting control module;

wherein the control terminal of the second light emitting control module is configured to receive the light emitting control signal;

wherein an input terminal of the second light emitting control module is electrically connected to an output terminal of the drive module, and an output terminal of the second light emitting control module is electrically connected to the reset node; and wherein the second light emitting control module comprises a ninth transistor.

17. The display panel of claim 1, wherein each of the plurality of pixel circuits further comprises a storage module;

wherein a first terminal of the storage module is electrically connected to the control terminal of the drive module, and a second terminal of the storage module is electrically connected to an input terminal of the first light emitting control module; and wherein the storage module comprises a storage capacitor.

18. A display device, comprising a display panel, wherein the display panel comprises an array substrate, wherein the array substrate comprises a plurality of pixel circuits arranged in an array, wherein each pixel circuit among the plurality of pixel circuits comprises a drive module, a first initialization module, a second initialization module, a first light emitting control module, a data writing module and a light emitting module;

wherein the drive module is configured to generate a drive current;

wherein the first initialization module and the second initialization module are connected in series to an initialization signal terminal and a control terminal of the drive module;

wherein an output terminal of the second initialization module is electrically connected to the control terminal of the drive module, and an output terminal of the first initialization module and an input terminal of the second initialization module each are electrically connected to a first intermediate node;

wherein the first light emitting control module is configured to transmit a first power signal to an input terminal of the drive module; the data writing module is configured to transmit a data signal to the input terminal of the drive module;

wherein the light emitting module is connected in series to the drive module and a second power signal terminal, wherein a first electrode of the light emitting module is electrically connected to a reset node, and a second electrode of the light emitting module is electrically connected to the second power signal terminal;

wherein a control terminal of the first initialization module is configured to receive a first additional scan signal, a control terminal of the second initialization module is configured to receive a first scan signal, a control terminal of the first light emitting control module is configured to receive a light emitting control signal, and a control terminal of the data writing module is configured to receive a second scan signal; and wherein within at least one light emitting period of one frame duration, an end time of an active level pulse of the first additional scan signal is later than an end time of an active level pulse of the first scan signal.

19. A method for driving an array substrate in a display device, wherein the method is, wherein the array substrate comprises a plurality of pixel circuits arranged in an array, wherein each of the plurality of pixel circuits comprises a drive module, a first initialization module, a second initialization module, a first light emitting control module, a data writing module and a light emitting module;

wherein the drive module is configured to generate a drive current;

wherein the first initialization module and the second initialization module are connected in series to an initialization signal terminal and a control terminal of the drive module, an output terminal of the second initialization module is electrically connected to the control terminal of the drive module, and an output terminal of the first initialization module and an input terminal of the second initialization module each are electrically connected to a first intermediate node;

wherein the first light emitting control module is configured to transmit a first power signal to an input terminal of the drive module; the data writing module is configured to transmit a data signal to the input terminal of the drive module;

wherein the light emitting module is connected in series to the drive module and a second power signal terminal, a first electrode of the light emitting module is electrically connected to a reset node, and a second electrode of the light emitting module is electrically connected to the second power signal terminal;

wherein a control terminal of the first initialization module is configured to receive a first additional scan signal, a control terminal of the second initialization module is configured to receive a first scan signal, a control terminal of the first light emitting control module is configured to receive a light emitting control signal, and a control terminal of the data writing module is configured to receive a second scan signal; and wherein within at least one light emitting period of one frame duration, an end time of an active level pulse of the first additional scan signal is later than an end time of an active level pulse of the first scan signal;

wherein the method at least comprises:

providing a first additional scan signal to the control terminal of the first initialization module; or providing a first scan signal to the control terminal of the second initialization module;

wherein within at least one light emitting period of one frame duration, the end time of an active level pulse of the first additional scan signal is later than the end time of an active level pulse of the first scan signal.

20. The driving method of claim 19, wherein the each pixel circuit further comprises a third initialization module, and wherein the driving method further comprises:

providing a third scan signal to a control terminal of a third initialization module;

wherein an enable frequency of the third scan signal is greater than an enable frequency of the first scan signal.

* * * * *